US005809373A

United States Patent [19]

Yoda et al.

[11] Patent Number: 5,809,373

[45] Date of Patent: Sep. 15, 1998

[54] IMAGE FORMING APPARATUS WHICH BACK-TRANSFERS RESIDUAL TONER FROM AN INTERMEDIATE TRANSFER MEMBER TO A PHOTOSENSITIVE DRUM

[75] Inventors: Yasuo Yoda, Kawasaki; Katsuhiko Nishimura, Yokohama; Koichi Hiroshima, Kawasaki; Shinichi Tsukida, Yono; Toru Kosaka, Machida, all of Japan

[73] Assignee: Canon Kabushiki Kaisha, Tokyo, Japan

[21] Appl. No.: 651,858

[22] Filed: May 21, 1996

[30] Foreign Application Priority Data

| | | | |
|---|---|---|---|
| May 23, 1995 | [JP] | Japan | 7-123904 |
| Jun. 2, 1995 | [JP] | Japan | 7-159977 |
| Jun. 2, 1995 | [JP] | Japan | 7-159978 |

[51] Int. Cl.[6] ..... G03G 15/16

[52] U.S. Cl. ..... 399/101; 399/129

[58] Field of Search ..... 399/101, 129, 399/302, 308

[56] References Cited

U.S. PATENT DOCUMENTS

| | | | |
|---|---|---|---|
| 5,079,597 | 1/1992 | Mauer et al. . | |
| 5,173,735 | 12/1992 | Kusumoto | 399/302 |
| 5,179,397 | 1/1993 | Ohzeki et al. . | |
| 5,198,863 | 3/1993 | Goto et al. . | |
| 5,264,902 | 11/1993 | Suwa et al. . | |
| 5,285,245 | 2/1994 | Goto et al. . | |

FOREIGN PATENT DOCUMENTS

| | | |
|---|---|---|
| 56-153357 | 11/1981 | Japan . |
| 61-279864 | 12/1986 | Japan . |
| 1-105980 | 4/1989 | Japan . |
| 4-296785 | 10/1992 | Japan . |
| 4-340564 | 11/1992 | Japan . |
| 5-297738 | 11/1993 | Japan . |
| 5-297739 | 11/1993 | Japan . |
| 5-303310 | 11/1993 | Japan . |
| 06-258857 | 9/1994 | Japan . |

*Primary Examiner*—Robert Beatty
*Attorney, Agent, or Firm*—Fitzpatrick, Cella, Harper & Scinto

[57] ABSTRACT

An image forming apparatus has an image bearing member; toner image forming unit for forming a toner image with non-magnetic toner on an image bearing member; intermediate transfer member contactable to the image bearing member and movable along an endless path; primary transfer unit for effecting primary image transfer of the toner image formed on the image bearing member onto the intermediate transfer member at a first transfer position; secondary transfer unit for effecting a secondary image transfer of the toner image from the intermediate transfer member on the transfer material at a second transfer position; and a residual toner charger for charging the residual toner remaining on the intermediate transfer member to a polarity opposite from a regular polarity thereof. After the secondary image transfer, the residual toner remaining on the intermediate transfer member is charged by the residual toner charger to the opposite polarity, and is then passed through the first transfer position during the primary image transfer, so that the residual toner is transferred back to the image bearing member substantially simultaneously with a next primary image transfer, thus removing the residual toner from the intermediate transfer member.

8 Claims, 16 Drawing Sheets

$$SF\ 1 = \frac{(MXLNG)^2}{AREA} \times \frac{\pi}{4} \times 100$$

$$SF2 = \frac{(PERI)^2}{AREA} \times \frac{\pi}{4} \times 100$$

| TNR / BIAS | MONO | | 4 CLRS | |
|---|---|---|---|---|
| | CLEANING | CLEANING GHOST | CLEANING | CLEANING GHOST |
| 0 | N | G | N | G |
| 5μA | F | G | N | G |
| 10μA | G | G | F | G |
| 20μA | G | G | G | G |
| 30μA | G | G | G | G |
| 40μA | G | F | G | G |
| 50μA | G | N | G | F |
| 60μA | G | N | G | N |

G : GOOD
F : FAIR
N : NO GOOD

FIG. 17

| TNR / BIAS | MONO | | 4 CLRS | |
|---|---|---|---|---|
| | CLEANING | CLEANING GHOST | CLEANING | CLEANING GHOST |
| 0 | N | G | N | G |
| 5μA | F | G | N | G |
| 10μA | G | G | F | G |
| 20μA | G | G | G | G |
| 30μA | G | G | G | G |
| 40μA | G | G | G | G |
| 50μA | G | F | G | G |
| 60μA | G | N | G | F |

G : GOOD

F : FAIR

N : NO GOOD

FIG. 18

| TNR / BIAS | MONO | | 4 CLRS | |
|---|---|---|---|---|
| | CLEANING | CLEANING GHOST | CLEANING | CLEANING GHOST |
| 0 | N | G | N | G |
| 5μA | F | G | N | G |
| 10μA | G | G | F | G |
| 20μA | G | G | G | G |
| 30μA | G | G | G | G |
| 40μA | G | G | G | G |
| 50μA | G | G | G | G |
| 60μA | G | F | G | G |

G : GOOD

F : FAIR

N : NO GOOD

FIG. 20

| TNR / BIAS | MONO | | 4 CLRS | |
|---|---|---|---|---|
| | CLEANING | CLEANING GHOST | CLEANING | CLEANING GHOST |
| 0 | N | G | N | G |
| 5μA | F | G | N | G |
| 10μA | G | G | F | G |
| 20μA | G | G | G | G |
| 30μA | G | G | G | G |
| 40μA | G | G | G | G |
| 50μA | G | G | G | G |
| 60μA | G | F | G | G |

G : GOOD

F : FAIR

N : NO GOOD

FIG. 21

IMAGE FORMING APPARATUS WHICH BACK-TRANSFERS RESIDUAL TONER FROM AN INTERMEDIATE TRANSFER MEMBER TO A PHOTOSENSITIVE DRUM

FIELD OF THE INVENTION AND RELATED ART

The present invention relates to an image forming apparatus such as a printer which outputs recorded images by transferring a toner image onto recording medium, or a copying machine which outputs copies of an original.

In the case of some of the color image forming apparatuses comprising an intermediate transfer member, two or more monochromatic color images composed of developers of different colors are formed on the intermediate transfer member by repeating a primary transfer process in which a transferable image formed on a first image bearing member is transferred onto the intermediate transfer member, and then, the monochromatic color images are transferred all at once onto the recording medium through a secondary transfer process. These color image forming apparatuses are remarkably effective as a color image forming apparatus since two or more monochromatic developer images of different colors can be accumulated without an alignment error, making it possible to synthesize a color image remarkably faithful to color image data.

However, in the image forming apparatus employing the intermediate transfer image, a certain amount of toner remains on the intermediate transfer member after the toner images are transferred from the intermediate transfer member onto the recording material through the secondary transfer process, and the removal of this residual toner presents a technical problem.

As for means for solving the above problem, Japanese Laid-Open Patent Application Nos. 153,357/1981 and 303,310/1993, or the like publications, propose a blade type cleaning means, which scrapes away the toner remaining on the intermediate transfer member by placing, for example, an elastic blade (cleaning blade) in contact with the intermediate transfer member.

According to another structure, a fur brush which can be placed in contact with, or moved away from, the intermediate transfer member is employed. In this case, the residual toner remaining on the intermediate transfer member after the secondary transfer process is transferred to the fur brush by applying to the fur brush a bias having the polarity opposite to that of the residual toner, and then, the residual toner transferred onto the fur brush is adhered to a bias roller such as a metallic roller. Finally, the residual toner is scraped away from the bias roller.

Further, Japanese Laid-Open Patent Application Nos. 340,564/1992 and 297,738/1993, and the like publications, propose another method. According to this method, in order to reduce the load imparted by cleaning the residual toner with the use of only the aforementioned blade type cleaning means, the residual toner on the intermediate transfer member is charged to the polarity opposite to the polarity of the surface potential of a photosensitive member as the first image bearing member, and then is returned to the photosensitive member by the effects of an electric field.

Japanese Laid-Open Patent Application No. 105,980/1989 proposes another structure. According to this structure, instead of providing both the intermediate transfer member and the photosensitive member with a cleaning apparatus of the same type, only a single charging device is provided for charging the residual toner on the intermediate transfer member to the polarity opposite to that of the charge polarity of the photosensitive member, however the post-secondary transfer residual toner on the intermediate transfer member is returned to the photosensitive member while the toner images are not transferred onto the intermediate transfer member through the primary transfer process. This publication also states that according to the cleaning structure proposed in this publication, the process, in which the residue on the intermediate transfer member is charged and returned to the photosensitive member, needs to be carried out only once during the production of a single copy, but repetition of the process renders the intermediate transfer member cleaner.

However, the conventional apparatuses for cleaning the intermediate transfer member suffer from the following shortcomings.

In a cleaning apparatus of a type in which the toner on the intermediate transfer member is scraped off with the use of a cleaning blade, when the blade is moved away from the intermediate transfer member, a portion of the toner having accumulated on the blade portion is left on the intermediate transfer member, causing a trace of the blade to appear as a part of the image during the following printing process. Further, the blade, and the surface layer of the intermediate transfer member with which the blade is placed in contact, wear out through usage, and as they wear out, they fail to clean the toner, or the transfer efficiency is reduced by the surface layer deterioration of the intermediate transfer member.

The cleaning apparatus which employs a fur brush to recover the residual toner on the intermediate transfer member also has a fault, that is, being costly due to its large size and complexity.

In the case of a cleaning apparatus which employs a corona type charging device or a bias roller as an auxiliary means for the blade type cleaning means, the intermediate transfer member is effectively cleaned as the residual toner on the intermediate transfer member is returned to the photosensitive member by the auxiliary means, which is different from the aforementioned method for mechanically cleaning the residual toner. However, this method requires an additional process, that is, a process for cleaning the intermediate transfer member after the completion of the normal image forming process; therefore, it has a weakness in that the throughput is extremely reduced when the image forming apparatus is in a mode for continuously forming images of different patterns, or in the like modes.

On the other hand, the structure disclosed in Japanese Laid-Open Patent application No. 105,980/1989 seems to be remarkably simple and effective in that only a single charging device for charging the residual toner on the intermediate transfer member to the polarity opposite to the charge polarity of the photosensitive member is provided, and the post-secondary toner on the intermediate transfer member is returned to the photosensitive member by the charging device alone after the completion of the primary transfer process.

However, according to this publication, the cleaning process is repeated one or more times (sequential cleaning) after the completion of each image formation (completion of each print).

In other words, according to the structure disclosed in this publication, the cleaning process is sequentially carried out after every primary transfer process; therefore, the throughput drops when images of different patterns are continuously printed.

SUMMARY OF THE INVENTION

Accordignly, it is a principal object of the present invention to provide an image forming apparatus using an intermediate transfer member, wherein the time required for cleaning the intermediate transfer member.

It is another object of the present invention to provide an image forming apparatus using an intermediate transfer member, wherein structure is simplified.

According to an aspect of the present invention, there is provided an image forming apparatus for forming a toner image on a transfer material using an intermediate transfer member, comprising an image bearing member; toner image forming means for forming a toner image with non-magnetic toner on an image bearing member; intermediate transfer member contactable to said image bearing member and movable along an endless path; bias voltage application means for effecting primary image transfer of the toner image formed on said image bearing member onto the intermediate transfer member at a first transfer position; transfer means for effecting a secondary image transfer of the toner image from the intermediate transfer member on the transfer material at a second transfer position; residual toner charging means for charging the residual toner remaining on the intermediate transfer member to a polarity opposite from a regular polarity thereof; wherein after the secondary image transfer, the residual toner remaining on the intermediate transfer member is charged by said residual toner charging means to the opposite polarity, and is then passed through the first transfer position during the primary image transfer, so that the residual toner is transferred back to said image bearing member substantially simultaneously with a next primary image transfer, thus removing the residual toner from said intermediate transfer member.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 17 is a table showing the cleaning bias dependency of the efficiency with which the surface of the intermediate transfer member is cleaned when the first photosensitive drum is employed.

FIG. 18 is a table showing the secondary transfer bias dependency of the efficiency with which the surface of the intermediate transfer member is cleaned when the second photosensitive member is employed.

FIG. 20 is a table showing the cleaning bias dependency of the efficiency with which the surface of the intermediate transfer member is cleaned when a photosensitive drum having a surface layer with mold releasing properties is employed.

FIG. 21 is a table showing the cleaning bias dependency of the efficiency with which the surface of the intermediate transfer member is cleaned when another photosensitive drum having a surface layer with the mold releasing properties is employed.

DESCRIPTION OF THE PREFERRED EMBODIMENTS

Hereinafter, the color image forming apparatus in accordance with the present invention will be described in more detail with reference to the drawings.

EMBODIMENT 1

Figure 1:
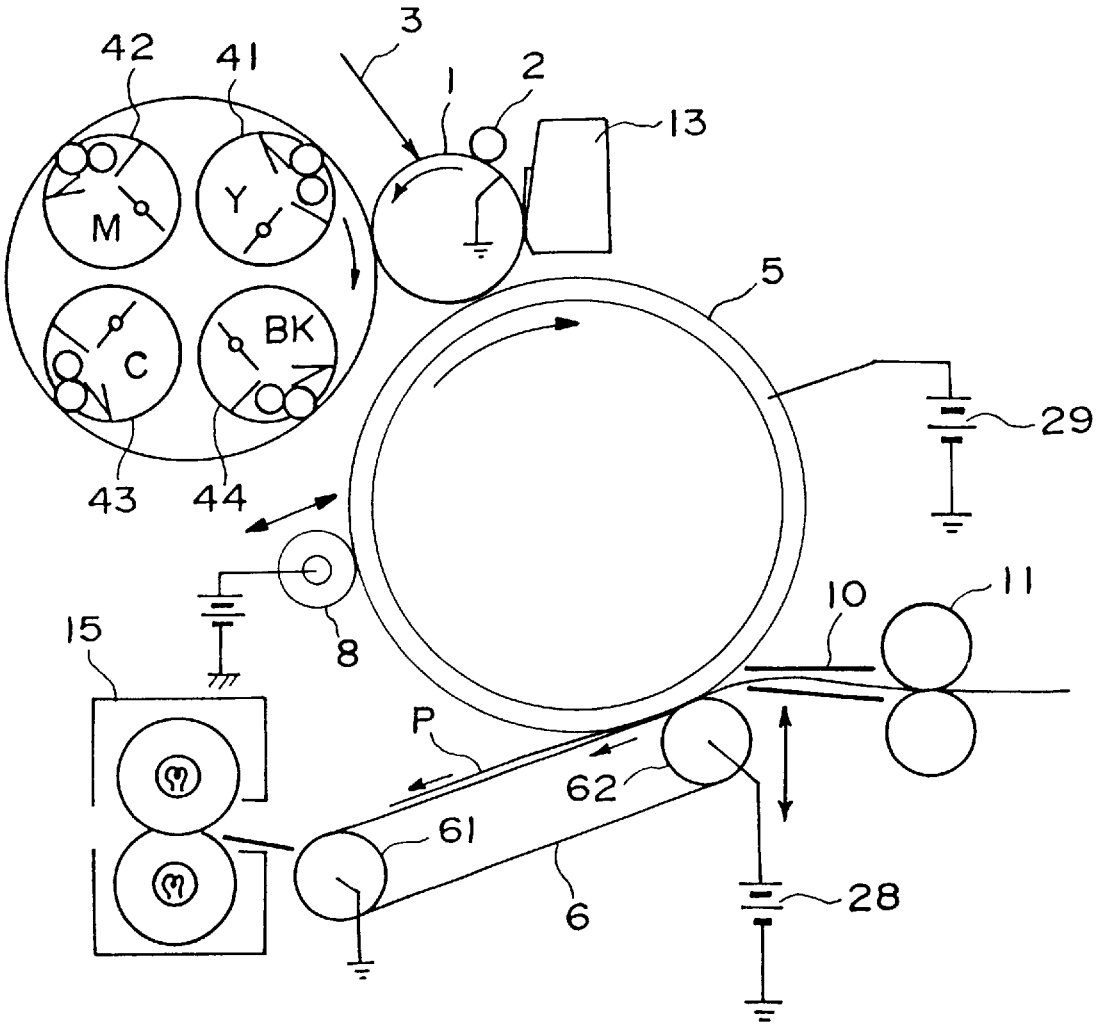
FIG. 1 is a schematic section of the laser printer, that is, an image forming apparatus, in the first embodiment of the present invention.

FIG. 1 is a schematic section of the structure of a color laser beam printer, that is, a color image forming apparatus based on an electro-photographic process, in the first embodiment of the present invention.

In this embodiment, the printer comprises an electrophotographic photosensitive member 1 (hereinafter, "photosensitive drum") which is repeatedly used as a first image bearing member. This photosensitive drum 1 is rotatively driven in the counterclockwise direction indicated by an arrow mark at a predetermined peripheral speed (process speed).

As the photosensitive drum 1 is rotated, it is uniformly charged by a primary charge roller 2 to a predetermined level of the negative potential. Next, the photosensitive drum 1 is exposed to an optical image by an image exposing means (unillustrated) comprising an optical system, a scanning exposure system, or the like. The optical system separates the colors of an original color image, and forms optical images to which the photosensitive drum 1 is to be exposed, and the scanning exposure means comprises, for example, a laser scanner which emits a laser beam having been modulated in response to sequential electric digital image signals correspondent to the image data. As a result, an electrostatic latent image correspondent to a first color component, for, example, yellow, of the target color image is formed.

In this embodiment, a so-called rotary developing apparatus comprising a yellow color developing device 41, a magenta color developing device 42, a cyan color developing device 43, and a black color developing device 44, is employed. Each developing device is rotated in the direction indicated by an arrow mark in the drawing by an unillustrated driving apparatus, and is positioned at a developing station where it faces the photosensitive drum 1 during the developing process. In FIG. 1, the yellow color developing device 41 is at the developing station.

The electrostatic latent image formed on the photosensitive drum is developed by a first developing device, that is, the yellow color developing device 41 in this embodiment, and the first color toner, that is, yellow toner Y in this embodiment, into a yellow toner image.

While the yellow toner image, that is, the toner image of the first color, on the photosensitive drum 1 is passed through the nip formed between the photosensitive drum 1 and the intermediate transfer member 5, a first transfer bias 29 is applied to the intermediate transfer member 5, generating an electric field, whereby the yellow toner image is transferred onto the peripheral surface of the intermediate transfer member 5 by the electric field and the nip pressure. Hereinafter, this process is called "primary transfer process."

The intermediate transfer member 5 in this embodiment is constituted of an elastic roller having a medium resistance, and is rotatively driven in the clockwise direction indicated by an arrow mark at the same peripheral speed as the photosensitive drum 1.

Thereafter, a magenta (second color) toner image, a cyan (third color) toner image, a black (fourth color) toner image are sequentially transferred onto the intermediate transfer member 5 in an overlapping manner. As a result, a compound toner image composed of the monochromatic toner images correspondent to various color components of the target image is formed on the intermediate transfer member 5.

In this embodiment, a transfer belt 6 is disposed below the intermediate transfer member 5. The transfer belt 6 is tensioned by a bias roller 62 and a tension roller 61 which support the bias roller 6, wherein a predetermined secondary transfer bias is applied to the bias roller 62, whereas the tension roller 61 is grounded.

The first transfer bias which transfers the negatively charged first to fourth color toner images from the photosensitive drum 1 to the intermediate transfer member 5, sequentially and in an overlapping manner, has the polarity opposite to that of the toner. In other words, it has the positive polarity in this embodiment, and is applied from a bias power source 29.

While the first color toner image to the fourth color toner image are sequentially transferred from the photosensitive drum 1 to the intermediate transfer member 5, the transfer belt 6, and an intermediate transfer member cleaning roller 8 which is a cleaning roller in accordance with the present invention, are kept away from the intermediate transfer member 5. The intermediate transfer member cleaning blade 8 will be described later in detail.

The monochromatic color toner images having been transferred onto the surface of the intermediate transfer member 5 in the overlapping manner are transferred onto the recording medium P by placing the transfer belt 6 in contact with the intermediate transfer member 5. More specifically, the recording medium P is delivered with a predetermined timing from a sheet feeder cassette (unillustrated) to the contact nip between the intermediate transfer member 5 and the transfer belt 6, by way of a registration roller 11 and a pre-transfer guide 10, and at the same time, the secondary transfer bias is applied to the bias roller 2 from the bias power source 28. The monochromatic toner images having been transferred onto the intermediate transfer member 5 are transferred onto the recording medium P by the secondary transfer bias. Hereinafter, this process for transferring the toner images from the intermediate transfer member 5 to the recording medium P will be called "secondary transfer process."

The recording medium P onto which the color toner images have been transferred all at once in the overlapping manner is introduced into a fixing device 15, being fixed therein, and then is discharged from the apparatus.

After the images are transferred onto the recording medium P, the intermediate transfer member cleaning means, which is the intermediate transfer member cleaning roller 8 in this embodiment, is placed in contact with the intermediate transfer member 5, and the toner remaining on the intermediate transfer member 5, that is, the post-secondary transfer residual toner, is charged by this intermediate transfer member cleaning roller 8 to the polarity opposite to the polarity of the toner which develops the latent image formed on the photosensitive drum, being prepared for the cleaning process in accordance with the present invention.

Next, the intermediate transfer member cleaning process which characterizes the present invention will be described.

According to the present invention, the intermediate transfer member cleaning means 8 transfers the post-secondary transfer process residual toner on the intermediate transfer member 5 back to the photosensitive drum 1 at the same time as the primary transfer process from the photosensitive drum 1 to the intermediate transfer member 5. The mechanism for this cleaning process will be described next.

When the toner images are transferred from the intermediate transfer member 5 onto the recording medium P on the transfer belt 6, the toner particles in the toner image are subjected to a strong electric field having the polarity opposite (positive polarity in this embodiment) to the normal polarity (negative polarity in this embodiment); therefore, the toner particles remaining on the intermediate transfer member 5 after the secondary transfer process, that is, the residual toner, are more likely than not to have the polarity opposite to the normal one. However, this does not means that the polarities of all the toner particles have been reversed to the positive ones. In other words, some of the toner particles in the residual toner are neutralized, bearing no charge, and some of them are partially neutralized, maintaining still the negative polarity.

The occurrence of this phenomenon was confirmed by conducting an experiment which will be described below.

A monochromatic text pattern and a solid white text pattern were printed in succession using a laser printer structured as depicted in FIG. 1. When the intermediate transfer member cleaning means was not available, a ghost-like positive pattern of the preceding text pattern, which resulted from the residual toner from the secondary transfer process of the preceding text pattern, appeared on the following solid white pattern print. The appearance of this ghost-like positive pattern was observed while varying the secondary transfer bias value relative to a predetermined value, discovering that the appearance of the resultant positive ghost image varied in response to the bias value, and the appearance of the positive ghost image was most improved (least visible) when the transfer bias was set at a value higher than the transfer bias value which gave the highest transfer efficiency.

Incidentally, it has been known that the efficiency with which the toner image is transferred onto the recording medium P peaks with a certain transfer bias value, and that application of an excessive amount of bias reduces the transfer efficiency.

However, the transfer efficiency observed in the experiments described above showed otherwise. Therefore, the inventors of the present invention made observational studies of the toner found on the intermediate transfer member 5 and the photosensitive drum 1 after the secondary transfer process.

When the secondary transfer process was carried out using a very strong secondary transfer bias, an extremely large amount of the residual toner was found on the intermediate transfer member 5, and at the same time, the toner was found on the photosensitive drum 1, which should have been clean after the completion of the primary transfer process. The appearance of the toner pattern on the photosensitive drum 1 confirmed that the post-secondary transfer process residual toner had been transferred back to the photosensitive drum 1 from the intermediate transfer member 5.

Careful studies of the above results confirmed that during the secondary transfer process, the polarity of the post-secondary transfer process residual toner had been reversed from the initial polarity, due to the application of a strong secondary transfer bias.

However, since the residual toner on the intermediate transfer member 5 after the secondary transfer process was partially composed of the neutralized toner or the negatively charged toner as described before, not all of the residual toner returned to the photosensitive drum 1, creating a ghost image on the following recording medium when in a continuous printing mode. Further, when the transfer bias is on the higher side of the optimum transfer bias, an excessive transfer current causes image deterioration, preventing the formation of an acceptable image in practical terms.

Thus, the inventors of the present invention conducted the following experiment. That is, a charging means, which was capable of not only charging the neutralized toner with no charge to the polarity opposite to that of the normal toner polarity, but also forcing the toner still maintaining the initial negative polarity, to reverse its polarity, was disposed at a point which, relative to the rotational direction of the intermediate transfer member 5, was past the secondary transfer point.

As a result, all the residual toner from the secondary transfer process was returned to the photosensitive drum 1; the inventors of the present invention confirmed that the reversal transfer was possible.

Further, it became evident that the reversely (positively) charged toner on the intermediate transfer member 5, and the normally (negatively) charged toner on the photosensitive drum 1, which are to be transferred onto the intermediate transfer member 5, do not neutralize each other by exchanging their charges, wherein the toner reversely charged by the cleaning roller 8 is transferred back onto the photosensitive drum 1, and the normally (negatively) charged toner is transferred onto the intermediate transfer member 5, within the nip.

The reason for the occurrence of the above phenomenon is that since the toner had insulating properties, the charge of the toner with the normal polarity, and the charge of the toner with the reverse polarity, did not respond to each other in a short time; neither was the toner polarity reversed nor neutralized. In other words, when a weaker electric field is generated at the primary transfer nip between the photosensitive drum 1 and the intermediate transfer member 5 by lowering the primary transfer bias, so that the toner is prevented from being charged in the undesirable direction by the electrical discharge which occurs in the nip, two groups of toner do not exchange their charges during the short time it takes for them to pass the primary transfer nip. As a result, the toner on the photosensitive drum 1 and the toner on the intermediate transfer member 5 behave independently of each other.

In this embodiment, a contact type charging means, more specifically, the intermediate transfer member cleaning roller 8 constituted of an elastic roller comprising several layers, is employed as the means for charging the toner remaining on the intermediate transfer member 5 after the secondary transfer process.

Figure 2:
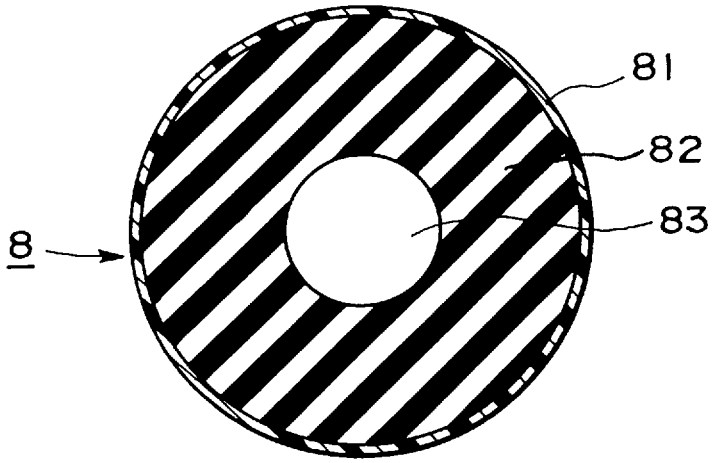
FIG. 2 is a schematic section of the cleaning roller for cleaning the intermediate transfer member employed in the laser printer of the first embodiment.

FIG. 2 is a schematic sectional view of the intermediate transfer member cleaning roller 8 actually used in this embodiment.

The cleaning roller 8 employed in this embodiment comprises an electrically conductive, cylindrical or columnar base member 83, an elastic layer 82 placed on the base member 83, and one or more covering layers 81 covering the elastic layer 82. The elastic layer 83 is composed of rubber, elastomer, or the like resins.

The material for the electrically conductive base member 83 in the cylindrical columnar form has only to be such material that is rigid enough not to allow the cleaning roller 8 to flex so that the cleaning roller 8 can be kept in contact with the intermediate transfer member 5, evenly across the entire length of the nip. For example, metallic material such as aluminum, iron, or copper, alloy material such as stainless steel, or electrically conductive resin in which carbon, metallic particle, or the like is dispersed, may be employed.

The elastic layer 82 has only to have a hardness sufficient to keep the cleaning roller 8 in contact with the intermediate transfer member 5 without leaving any gap between the two components, and a certain degree of electrically insulating properties relative to the bias to be applied.

More specifically, the following rubber material can be listed: acrylonitrile-butadiene-rubber (NBR), styrene-butadiene rubber, butadiene rubber, ethylene-propylene-rubber, chloroprene rubber, chlorosulfonated-polyethylene, chlorinated polyethylene, acrylic rubber, fluorocarbon rubber, urethane rubber, urethane sponge, and the like. The resistance value is desirable to be $10^5$–$10^{11}$ Ω/cm, preferably, $10^5$–$10^7$ Ω/cm (when a voltage of 1 kV is applied), in volumetric resistance. The overall resistance value of the intermediate transfer member cleaning roller 8 will be described later.

The material selection for the covering layer 81 is one of the essential factors in terms of intermediate transfer member cleaning. This is because the function required of the intermediate transfer member cleaning roller 8 is the same as that of the charge roller 2 for charging the surface of the photosensitive drum 1.

The charge roller for charging the surface of the photosensitive drum 1 may be a roller with only a single layer as long as its resistance value is extremely stable, and its surface is void of minute irregularities in resistance, so that it can satisfactorily function. This is because the charging effect is dependent on the electrical discharge which occurs between the surface material of the photosensitive drum and the surface material of the charge roller when a voltage is applied between the two materials, and the electrostatic capacity which contributes to the electrical discharge is determined by the resistance value.

Therefore, in order to control the resistance, and also to suppress the effects of the minute resistance irregularities present on the surface of the roller, the roller is preferred to be structured in two layers so that two functions are separately handled, that is, the resistance value is roughly controlled by the elastic layer 82, the lower layer, and is finely controlled by the covering layer 81, the surface layer. Also, this arrangement is preferable from the standpoint of manufacturing, for example, latitude in material selection, cost, and the like.

Accordingly, the two layer structure is employed in this embodiment. As for the material to be used for the covering layer 81, compound material composed of resin material such as nylon resin, urethane resin, or fluorocarbon resin, and metallic oxide such as titanium oxide or tin oxide which is dispersed in the resin material to control the resistance, is preferable.

The covering layer may be a type of resin sheet which is wrapped over the elastic layer 82.

The covering layer must have appropriate resistance for allowing the occurrence of electrical discharge when the roller 8 is placed in contact with the intermediate transfer member 5. More specifically, a surface resistance value within a range of $10^6$–$10^{15}$ Ω/cm, more preferably, $10^{11}$–$10^{15}$ Ω/cm$^2$, (when 1 kV is applied) is effective.

The surface resistance is measured in the following manner. A sample of the covering layer 8 is composed of an electrically conductive sheet with a size of 100 mm×100 mm, and a surface layer coated thereon under similar conditions, and the resistance of this sample is measured with an R8340A and an R12704 of Advantest Corp. The voltage to be applied is 1 kV, wherein the discharge time and the charge time are 5 seconds and 30 seconds, respectively, and the measuring time is 30 seconds.

The cleaning roller 8 employed in this embodiment comprises a metallic core 83 of stainless steel, an elastic member 82 of urethane sponge, and a covering layer 81. The external diameter of the metallic core is 14 mm. The thickness and volumetric resistivity of the elastic layer 82 are 3 mm and $10^5$ Ω/cm (when 1 kV is applied), respectively. The covering layer 81 is composed of polyamide methoxylate in which titanium oxide is dispersed. Its thickness and surface resistance value are 10 μm and $10^{13}$ Ω, respectively. The external diameter of the roller 8 is approximately 20 mm.

Figure 3:
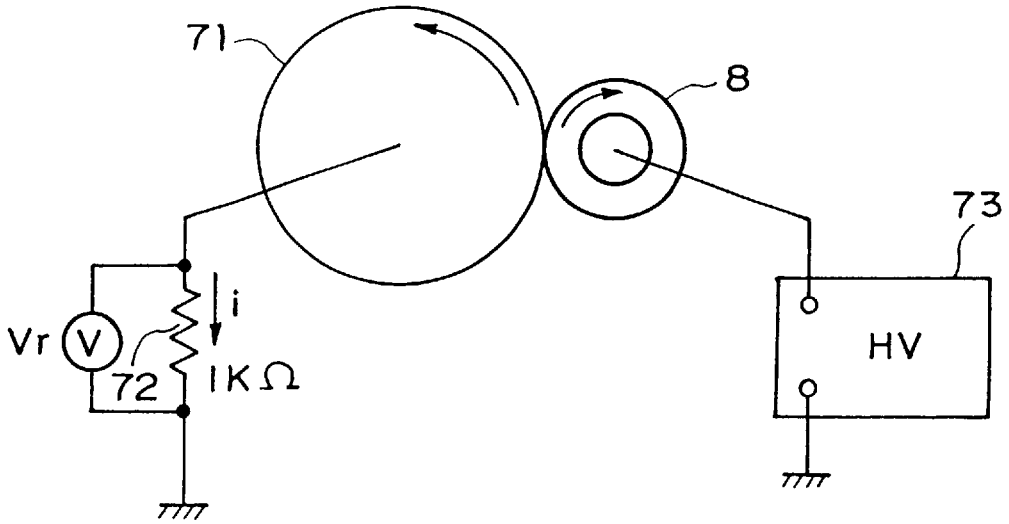
FIG. 3 is a schematic section of an instrument for measuring the resistances of the intermediate transfer member cleaning roller and the intermediate transfer member in accordance with the present invention, under an actual usage conditions.

The resistance of the aforementioned intermediate transfer member cleaning roller 8 in terms of actual usage is measured using the method depicted in FIG. 3. Here, "resistance in terms of actual usage" means an overall resistance of the intermediate transfer member cleaning roller 8 including the elastic layer 82, and the covering layer 81.

Referring to FIG. 3, an aluminum cylinder 71 is rotatively driven by an unillustrated driving force source such as a motor, and the cleaning roller 8 follows the rotation of the aluminum cylinder 71. The contact pressure between the two components is set up to be substantially the same as when the cleaning roller 8 is actually disposed in the apparatus illustrated in FIG. 1. The overall contact pressure is 1 Kgf. A stable DC voltage Vdc is applied from a high voltage power source 73 to the metallic core of the cleaning roller 8. The current which flows through the elastic layer 82 and covering layer 81 of the cleaning roller 8 flows into the aluminum cylinder 71, and then, flows to the ground through a standard resistor 72. When the voltage Vr between the two ends of the standard resistor 72 is Vr (V), the resistance value Rc of the cleaning roller 8 is obtained from the following formula:

$$Rc(\Omega)=10^6/Vr(V)$$

The obtained resistance of the cleaning roller 8 in terms of actual usage was $4\times10^8$ Ω.

After careful studies, the inventors of the present invention discovered that the preferable resistance value of the cleaning roller 8 in terms of actual usage was within a range of $5\times10^5$–$1\times10^{10}$ Ω/cm, more preferably, $10^8$–$10^{10}$ Ω/cm as measured using the aforementioned method.

It was also confirmed that the covering layer 81 was more effective when its thickness was 5–100 μm.

Figure 4:
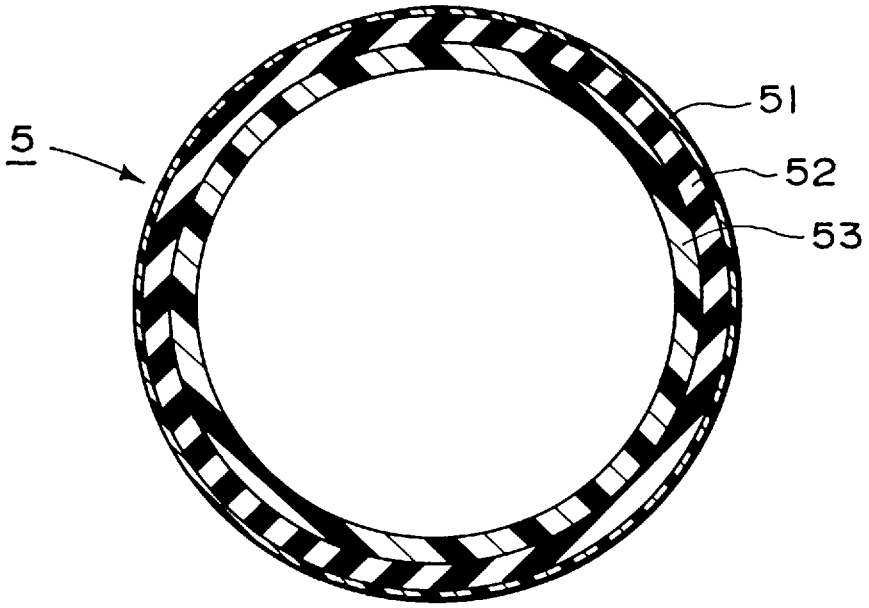
FIG. 4 is an enlarged sectional view of the intermediate transfer member.

Next, the intermediate transfer member 5 employed in this embodiment will be described with reference to FIG. 4.

The intermediate transfer member 5 employed in this embodiment is also in the form of a roller. It comprises an electrically conductive, cylindrical, rigid base member 53, and at least an elastic layer 52 composed of rubber, elastomer, or the like material, and a surface layer 51 laid on the elastic layer. The surface layer further comprises two or more sublayers.

As for the material for the electrically conductive, cylindrical base member 53, electrically conductive resin material, in which particles of metallic material such as aluminum, iron, or copper, particles of alloy material such as stainless steel, particles of carbon, or the like particles are dispersed, may be employed. As for the structure of the cylindrical base member 53, it is in the form of the aforementioned cylinder, wherein a central shaft may penetrate through the longitudinal axis of the cylinder, or reinforcement material may fill the interior space of the cylinder. The metallic core employed in this embodiment is constituted of a 3 mm thick aluminum cylinder, and the reinforcement material is disposed within the internal void.

The thickness of the elastic layer 52 of the intermediate transfer member 5 is preferred to be 0.5–7.0 mm in consideration of the formation of the transfer nip, the rotational color misalignment, the material cost, and the like factors. The surface layer 51 is preferred to be thin enough to allow the effects of the elasticity of the elastic layer 52, that is, the underlayer, to reach the surface of the photosensitive drum 1 through the surface layer 51. Preferably, it is 5–100 μm. In this embodiment, the thicknesses of the elastic layer 52 and the surface layer 51 of the intermediate transfer member 5 are 5 mm and 10 μm, respectively, and the overall external diameter of the intermediate transfer member 5 is 180 mm.

Further, with emphasis placed only on the resistance value of the elastic layer 52, acrylonitrile-butadiene rubber (NBR) is used as the material for the elastic layer 52, and Ketchen black is dispersed therein to control the resistance. Further, the same material as that used for the elastic layer of the aforementioned intermediate transfer member cleaning roller 8 may be listed as the rubber material usable for the elastic layer 52.

As for the electrically conductive material, carbon black, aluminum particles, nickel particles, and the like may be employed. Further, it is conceivable to employ electrically conductive resin instead of dispersing electrically conductive agent into non-conductive resin. As for specific names of the usable conductive materials, it is possible to list polymethyl methacrylate containing fourth-class ammonium salt, polyvinyl aniline, polyvinyl pyrrol, polydiacetylene, polyethylene imine, and the like.

The volumetric resistivity is measured in the following manner. The aforementioned elastic layer 52 is cut to a size of 100 mm×100 mm, with an optional thickness, and the volumetric resistance of this piece is measured using an R8340A and an R12704 of Advantest Corp. As for the measurement conditions, the applied voltage is 1 kV; the discharge time, 5 seconds; the charge time, 30 seconds; and the measurement time is 30 seconds.

The surface layer 51 of the intermediate transfer member 5 is important since it greatly affects the efficiency with which the secondary transfer residual toner is cleaned. As for the material for the surface layer 51, urethane resin is used as binder, in which aluminum boride whisker is dispersed as the conductive material for controlling resistance, and PTFE powder is dispersed to improve mold releasing properties.

The resistance of the above surface layer is measured using the same method. It is $10^{12}$ Ω/cm (when 1 kV is applied). After careful studies, the inventors of the present invention discovered that when the surface layer resistance was within a range of $10^8$–$10^{12}$ Ω/cm, a preferable cleaning performance could be obtained.

The combined resistance of the elastic layer 52 and the surface layer 51 in terms of actual usage is $10^7$ Ω/cm (when 1 kV was applied). Also, the resistance of the intermediate transfer member 5 in terms of actual usage is measured using the same method as that used to measure the aforementioned intermediate transfer member cleaning roller 8, including the measuring system depicted in FIG. 3.

Next, the toner employed in this embodiment will be described.

The toner employed in this embodiment is a nonmagnetic toner containing the toner particles in the irregular shapes, manufactured from styrene resin binder using a pulverizing method. It has a shape factor SF1 of 153, and a shape factor SF2 of 145, and its particle diameter is 7 μm. It is mixed with oil treated silica. As for the comparative toner, it is a magnetic toner, the particles of which are in the irregular form. It is composed of a copolymer of styrene-butylacrylate-butylmaleate halfester, as a binder, and 100 parts of magnetic material such as magnetite, and is manufactured using the pulverizing method. Its shape factors SF1 and SF2 are 156 and 146, respectively. Its particle diameter is 7 μm. This toner is also mixed with oil treated silica.

Figure 5:
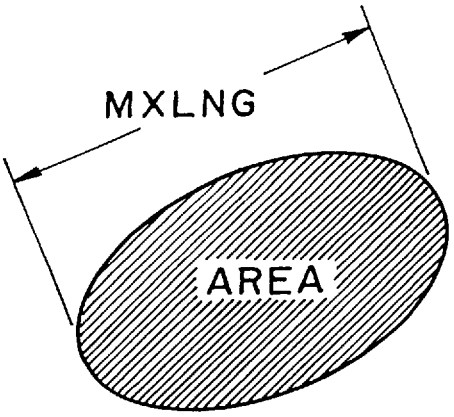
FIG. 5 is an explanatory drawing describing a shape factor SF1.

Referring to FIG. 5, the shape factor SF1 mentioned in the foregoing is a value which indicates the roundness ratio of a spherical object. It is obtained in the following manner; the square of the maximum length MXLNG of an elliptic figure obtained by projecting a spherical object on a two dimensional flat surface is divided by the area size AREA of the elliptic figure, and the quotient is multiplied by 100π/4.

In other words, the shape factor SF1 is defined by the following formula:

$$SF1=\{(MXLNG)^2/AREA\}\times(100\pi/4)$$

Figure 6:
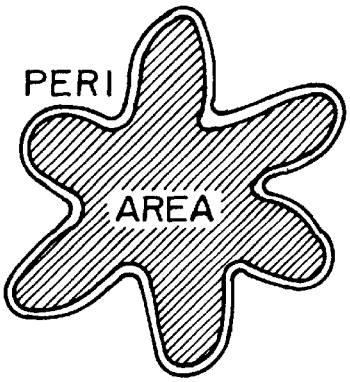
FIG. 6 is an explanatory drawing describing a shape factor SF2.

Referring to FIG. 6, the shape factor SF2 is a numerical value which indicates, in ratio, configurational irregularity of an object. It is obtained in the following manner; the circumference PERI of a figure obtained by projecting an object onto a two dimensional flat surface is divided by the area size AREA of the figure, and the obtained quotient is multiplied by 100π/4.

In other words, the shape factor SF2 is defined by the following formula:

$$SF2=\{(PERI)^2/AREA\}\times(100\pi/4)$$

In this embodiment, SF1 and SF2 are obtained as follows. Toner images were randomly sampled using an FE-SEM (S-800), a product of Hitachi, Ltd., and the obtained data are analyzed by introducing them into an image analysis apparatus (LUSEX3), a product of NIKORE Corp., through an interface. Then, the final values were obtained from the above formulas.

The triboelectric charges of the above mentioned two toners employed in this embodiment are approximately −15 μC/g.

The photosensitive drum 1 employed in this embodiment is composed of OPC, and has an external diameter of 60 mm. It comprises a 0.2–0.3 μm thick carrier generation layer, and a 15–25 μm thick carrier transfer layer (hereinafter, CT layer) laminated thereon. The carrier generation layer is composed of phthalocyanine compound, and the CT layer is composed of polycarbonate (hereinafter, PC), that is, a binder, and a hydrazone compound dispersed therein.

In this embodiment, a transfer belt 6 is employed as the secondary transfer means. It does not matter whether or not a bias roller 62 and a tension roller 61, which support the transfer belt 6, are made of the same material or different material. In this embodiment, NBR with a volumetric resistivity of $5\times10^7$ Ω·cm (when 1 kV is applied) is employed. Its hardness is 30°–35° in JIS A. Both rollers comprise a SUS core with a diameter of 8 mm, wherein the surface layer is placed so that the external diameter of each roller becomes 20 mm.

Regarding the material for the above rollers 61 and 62, selection is optional as long as the volumetric resistivity is within a range of $1\times10^4$–$1\times10^9$ Ω/cm (when 1 kV is applied), and voltage dependency is not extremely large. In other words, in addition to the material employed in this embodiment, other material such as EPDM, urethane rubber, or CR, in which appropriate conductive agent can be dispersed, may be employed.

The transfer belt 6 is in the form of a tube, which is 80 mm in external diameter; 300 mm in length; 100 μm in wall thickness; and $10^8$–$10^{15}$ Ω/cm involumetric resistivity (when 1 kV is applied).

In this embodiment, a resin belt is employed as the transfer belt 6. It is made of compound material containing polycarbonate denatured by silicon, and carbon dispersed therein to control the volumetric resistivity and the surface resistance; the former is $10^{11}$ Ω/cm, and the latter is $10^{12}$–$10^{13}$ Ω.

The following materials can be listed as other materials usable for the transfer belt 6. As for the resin materials, there are polycarbonate (PC), nylon (PA), polyester (PET), polyethylene naphthalate (PEN), polysulfon (PSU), polyethersulfon (PEI), polyetherimide (PEI), polyethernitrile (PEN), polyether-etherketone (PEEK), thermoplastic polyimide (TPI), thermo-hardening polyimide (PI), PES alloy, polyvinylidene fluoride (PVdF), ethylenetetrafluoroethylene copolymer (ETFE), and the like. As for the elastomer materials, there are polyolefin thermoplastic elastomer, polyester thermoplastic elastomer, polyurethane thermoplastic elastomer, polyurethane thermo-hardening elastomer, polystyrene thermoplastic elastomer, polyamide thermoplastic elastomer, fluorocarbon thermoplastic elastomer, polybutadiene thermoplastic elastomer, polyethylene thermoplastic elastomer, ethylene-vinyl acetate copolymer thermoplastic elastomer, polyvinyl chloride thermoplastic elastomer, and the like.

Other conditions are as follows:

Contact pressure applied to photosensitive drum 1 by intermediate transfer member 5: 2 Kgf Contact pressure applied to intermediate transfer member 5 by intermediate transfer member cleaning roller 8: 1 Kgf Contact pressure applied to intermediate transfer member 5 by transfer belt 6: 5 Kgf Dark potential on photosensitive drum (potential given by primary charge): Vd=600 V Light potential on photosensitive drum (potential of spot exposed to laser beam): Vl=250 V Development method: jumping development using nonmagnetic single component developer Development bias: Vdc=−400 V; Vac=1600 Vpp; frequency=1800 Hz Process speed: 120 mm/sec Primary transfer bias: +100 V The aforementioned components are installed into the laser printer illustrated in FIG. 1, and the intermediate transfer member cleaning performance is confirmed under the conditions detailed in the foregoing.

As for the timing with which the cleaning roller 8 is placed in contact with the intermediate transfer member 5, when in a monochromatic continuous mode (mode for continuously producing two or more monochromatic prints), the cleaning roller 8 is placed in contact with the intermediate transfer member 5 at the same time as the primary transfer process is started. This is to prevent the image being formed from becoming disturbed by the shock generated by the contact. On the other hand, when in a four color multiple image transfer mode (mode for producing a color print bearing a color image composed of overlapping four color toner images), the cleaning roller 8 is placed in contact with the intermediate transfer member 5 at the same time as the primary transfer process for the fourth color ends.

Figure 7:
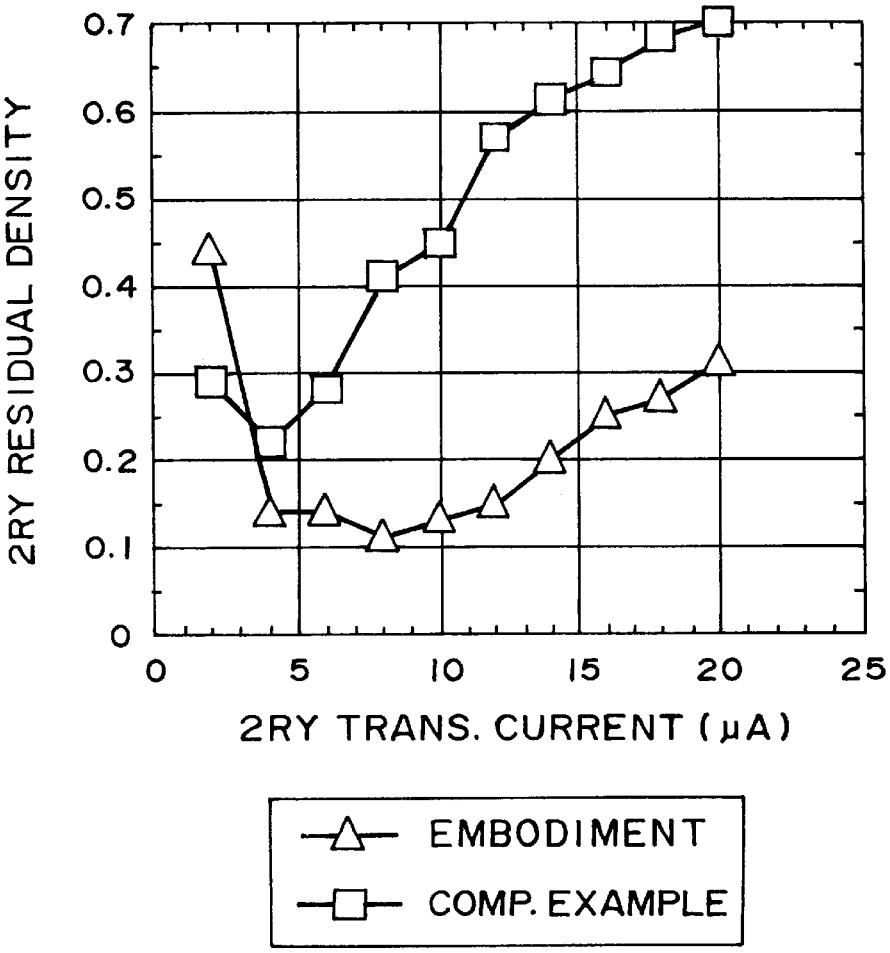
FIG. 7 is a graph showing the relationship between the secondary transfer current, and the density of the toner remaining on the intermediate transfer member after the secondary transfer, in the first embodiment.

FIG. 7 is a graph showing the secondary transfer bias dependency of the density of the toner remaining on the intermediate transfer member 5 after the secondary transfer process, with reference to both the magnetic and nonmagnetic toners described above. As for the measurement of the residual toner density, the toner remaining on the intermediate transfer member 5 after the secondary transfer process is actually recovered by adhering it to a piece of adhesive tape, and then, the density of the recovered toner on the tape is measured using a Macbeth densitometer.

In FIG. 7, compared to the magnetic toner, the secondary transfer bias range in which the post-secondary transfer residual toner density becomes minimum is wider for the nonmagnetic toner, and in addition, its post-secondary transfer residual toner density is lower for the nonmagnetic toner. The amount of toner on the intermediate transfer member 5 before the secondary transfer was 0.7 mg/cm$^2$.

Obviously, in order to clean the intermediate transfer member with preferable results, the amount of the residual toner on the intermediate transfer member 5 is preferred to be as small as possible.

When the amount of the residual toner is large, a strong cleaning bias has to be applied to the intermediate transfer member cleaning roller 8 to return the residual toner to the photosensitive drum 1 through the process of charging the residual toner by the cleaning roller. However, when the residual toner on the intermediate transfer member 5 is charged by such a strong bias to clean it, the toner which has been charged to the reverse polarity (positive in this embodiment) through the secondary transfer process is charged to a higher level, causing toner particles with an abnormally high level of charge to appear among the residual toner particles on the intermediate transfer member 5.

Figure 12:
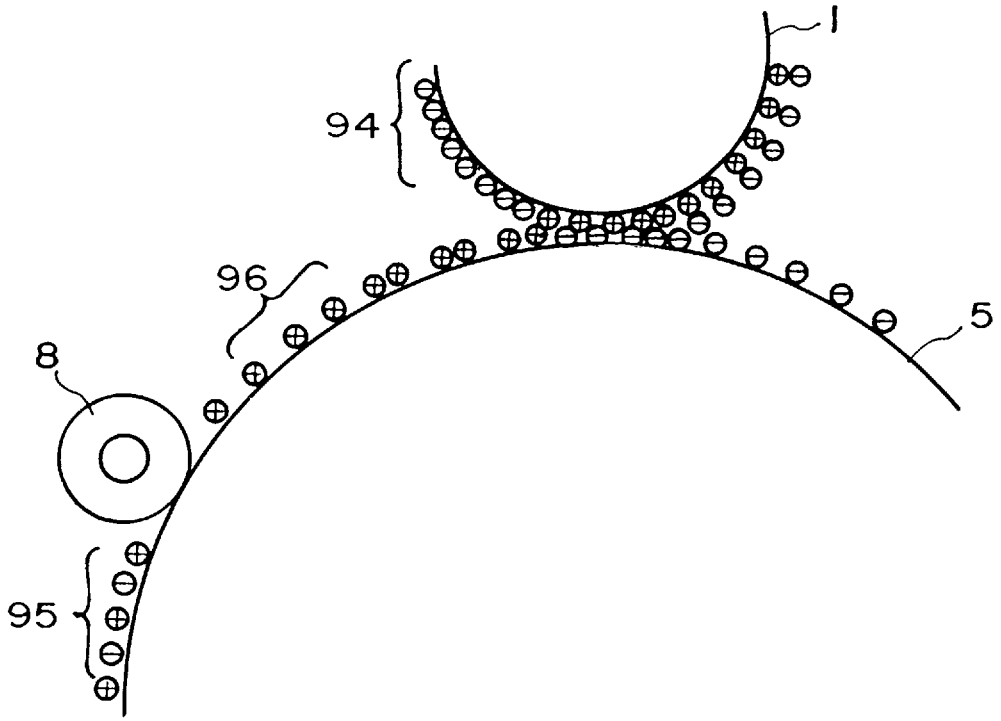
FIG. 12 is an explanatory drawing depicting a mechanism through which a negative ghost related to the cleaning of the intermediate transfer member is created.

FIG. 12 schematically depicts the above described phenomenon.

The above described phenomenon will be described with reference to FIG. 12. When the-value ($\mu$C/g) of the triboelectric charge of the toner particles 94 on the photosensitive drum 1 before the primary transfer process is approximately −15 $\mu$C/g, it will show no change immediately after the primary transfer process. This is because the primary transfer bias is +100 V, which is rather low. The primary transfer bias is set at this level because it was confirmed that when the primary transfer bias is increased, the ratio of the toner, the polarity of which has been reversed, becomes higher on the intermediate transfer member 5 than on the photosensitive drum 1, reducing the secondary transfer efficiency. Thus, the primary transfer bias is set at the aforementioned value.

The toner transferred onto the intermediate transfer member 5 through the primary transfer process is transferred onto the recording medium P through the secondary transfer process while maintaining the triboelectric charge of −15 $\mu$C/g.

A majority of the toner particles remaining on the intermediate transfer member 5 after the secondary transfer process are the toner particles with positive polarity, that is, the toner particles, the polarities of which have been reversed from the normal polarity through the secondary transfer process. The value of the triboelectric charge of the toner on the intermediate transfer member 5 after this polarity reversal was +10–+20 $\mu$C/g.

Further, as the polarity of almost all of the residual toner particles 95 is reversed by applying a bias to the cleaning roller 8, the value of the triboelectric charge of the toner particles 96 having passed by the cleaning roller 8 increases to +40–+50 $\mu$C/g.

As described above, the residual toner is positively charged to a higher level. Consequently, the residual toner efficiently returns to the photosensitive drum 1 through the reverse transfer process.

However, referring to FIG. 12, when the amount of the toner 95 is large, or when there are toner particles positively charged to an abnormally high level, a certain number of toner particles in the toner 94 transferring onto the intermediate transfer member 5 through the primary transfer process are pulled back to the photosensitive drum 1 by the toner 96 transferring onto the photosensitive drum 1 through the reverse transfer process.

When prints are continuously produced under the above condition, the trace of the toner image from the preceding print appears, as a negative ghost, on the following prints. This phenomenon is called "cleaning ghost" by the inventors of the present invention.

Thus, in order to clean the intermediate transfer member 5 in accordance with the present invention, the amount and charge level of the toner 96 to be returned to the photosensitive drum 1 must be controlled to some degree so that cleaning failure does not occur nor does the negative ghost appear. The inventors of the present invention could prevent the cleaning failure and the negative ghost appearance by optimizing the transfer bias and the the value of the bias applied to the cleaning roller 8, and by using the nonmagnetic toner.

Referring to FIG. 7, a bias range in which both toner density lines display substantial minimum values is the optimum secondary transfer bias range adopted in this embodiment. More specifically, in the case of the nonmagnetic toner, 8 $\mu$A was used, and in the case of the magnetic toner, that is, the comparative toner, 4 $\mu$A was used.

Table 1 shows the degree of cleaning failure and cleaning ghost appearance when the value of the bias applied to the cleaning roller is varied while using the nonmagnetic toner and the magnetic toner.

TABLE 1

| | TONER | | | |
|---|---|---|---|---|
| | COMP.EXAMPLE: IRREGULAR MAG. TONER | | EMBODIMENT: IRREGULAR NON-MAG. TONER | |
| APPLIED BIAS | CLEANING | CLEANING GHOST | CLEANING | CLEANING GHOST |
| 0 $\mu$A | N | G | N | G |
| 5 $\mu$A | N | G | N | G |
| 10 $\mu$A | N | G | N | G |
| 20 $\mu$A | N | G | F | G |
| 30 $\mu$A | N | G | G | G |
| 40 $\mu$A | F | G | G | N |
| 50 $\mu$A | F | G | G | N |

G: Good,
F: Fair,
N: No good

Referring to Table 1, when the magnetic toner was used as the developer, the cleaning failure occurred no matter which cleaning bias value was employed to charge the residual toner on the intermediate transfer member; therefore, it was impossible to clean the intermediate transfer member at the same time as the primary transfer process. On the other hand, in the case of the nonmagnetic toner, the cleaning failure occurred when the bias value was in a range of 0–20 $\mu$A, and the cleaning ghost appeared when the bias value was no less than 40 $\mu$A, whereas when the cleaning bias value was 30 $\mu$A, the primary transfer process, and the reversal transfer process, that is, residual toner cleaning process, were both successfully carried out at the same time.

The frequency at which the cleaning failure occurs or the cleaning ghost appears varies depending on the type of the developer. It is possible to think that this phenomenon is related to the amount of the residual toner 95 (mg/cm$^2$). Referring to FIG. 7 again, when the optimal secondary transfer bias was adopted, the amount of the post-secondary transfer residual toner 95 was larger for the magnetic toner than for the nonmagnetic toner. Thus, it is possible to think that in the case of the nonmagnetic toner, even when the cleaning current was increased, it was impossible to reverse the polarity of the entire post-secondary transfer residual toner 95 to the positive polarity, and as a result, the occurrence of the cleaning failure could not be prevented.

As described above, the intermediate transfer member cleaning means in this embodiment has the following effects:

(1) The residual toner on the intermediate transfer member can be cleaned at the same time as the primary transfer; therefore, it is unnecessary to provide the color laser beam printer or the color copying machine with an additional operational step for cleaning the residual toner on the intermediate transfer member after the production of each print in the continuous printing mode, while the primary transfer process is not carried out. As a result-, the throughput in the continuous printing mode can be improved.

(2) The residual toner on the intermediate transfer member 5 can be cleaned by a charging device alone whether the charging device is of the contact type or the noncontact type; therefore, the structure is extremely simple. As a result, a low-cost cleaning means can be provided.

(3) Unlike the conventional blade type cleaning, the fur brush type cleaning, and the like, the cleaning means in this embodiment does not cause mechanical damages to the employed components; therefore, a reliable and long lasting intermediate transfer member cleaning means can be provided.

In this embodiment, a roller with an external diameter of 20 mm was employed as the cleaning roller 8, but the careful studies conducted by the inventors of the present invention confirmed that any roller suffices to provide similar effects as long as its external diameter is within a range of 12–30 mm.

Further, in this embodiment, a cylindrical photosensitive drum, and a cylindrical intermediate transfer member were employed, but obviously, a photosensitive member in the form of a belt, or an intermediate transfer member in the form of a belt can provide the same effects without any problem.

Further, in this embodiment, a belt type transfer system was employed as the secondary transfer means, but employment of a corona type transfer system, or a transfer roller system, of the conventional type, does not affect the effects of the present invention.

Further, this embodiment was described with referencen to the reversal development system, but the same effects can be expected even when the normal development system is employed, which will be concisely described below.

When the normal development system is employed, positively chargeable toner, that is, toner chargeable to the polarity opposite to that of the toner employed in this embodiment, is employed, provided that the polarity of the latent image is the same as that in this embodiment. In this case, the background exposure is used, but the relationship in electrical potential between the dark potential region and the light potential region on the photosensitive drum basically remains the same even though their polarities are reversed.

When the polarity of the primary transfer voltage applied to the intermediate transfer member becomes the same as that of the photosensitive drum, the intermediate transfer member cannot be cleaned; therefore, the ground potential is used. The toner on the photosensitive drum can be satisfactorily transferred even by the ground potential, due to the contrast in potential, and the intermediate transfer member is cleaned as the residual toner on the intermediate transfer member is reversely transferred onto the photosensitive drum due to the presence of this contrast in potential.

The secondary transfer voltage for transferring the image onto a sheet of paper has the negative polarity, that is, the polarity opposite to that in this embodiment.

Since the polarity on the photosensitive drum is negative, the polarity of the intermediate transfer member cleaning bias must be rendered positive in order to charge all the secondary transfer residual toner to the positive polarity.

When the conditions in terms of polarity, and other conditions are adjusted as described above, the same effects as those obtained in this embodiment can be obtained even when the normal development system is used. Incidentally, the specific structure of the apparatus is the same as that illustrated in FIG. 1, and the apparatus is operated with above described changes to the polarity of the voltage applied to various members.

EMBODIMENT 2

In this second embodiment of the present invention, a polymer toner manufactured using the suspension polymerization method was employed as the developer. The particles had irregular shapes, wherein the shape factor SF1 was 160 and the shape factor SF2 was 148.

The resin portion of the polymer toner was styrene-butylacrylate. Further, when the toner was actually used, the oil treated silica was added to stabilize the triboelectric charge.

Figure 8:
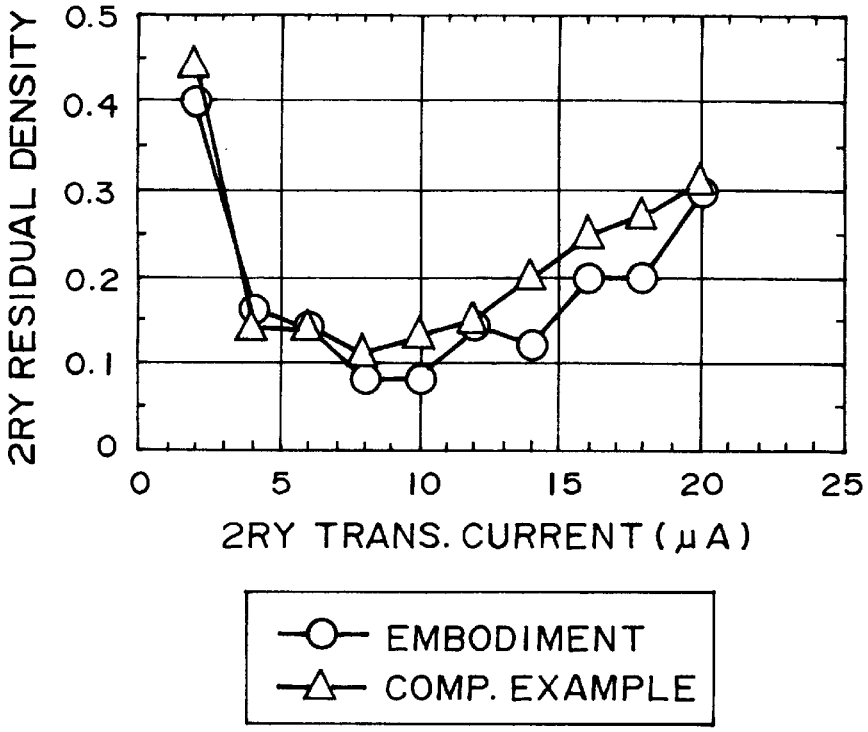
FIG. 8 is a graph showing the relationship between the secondary transfer current, and the density of the toner remaining on the intermediate transfer member after the secondary transfer, in the second embodiment.

FIG. 8 shows the secondary transfer bias dependency of the post-secondary transfer residual toner density for the nonmagnetic polymer toner of this embodiment, which contained toner particles in the irregular shapes. For comparison, it also shows the same for the nonmagnetic toner containing the toner particles in the irregular shapes, which was manufactured using the pulverizing method, and was employed in the first embodiment.

In FIG. 8, the minimum value of the post-secondary transfer residual toner density for the nonmagnetic toner is smaller than that for the nonmagnetic toner manufactured using the pulverizing method. The amount of the toner on the intermediate transfer member 5 before the secondary transfer was 0.7 mg/cm$^2$.

As for the secondary transfer bias, an optimum secondary transfer bias determinable from FIG. 8 was used for each toner. More specifically, a bias of 8 $\mu$A was used for both the polymer toner of this embodiment in the irregular shapes, and the comparative nonmagnetic toner manufactured by the pulverizing method in the irregular shapes.

Table 2 shows the results of another experiment in which the nonmagnetic toner in the irregular shapes, and the nonmagnetic polymer toner in the irregular shapes, were employed, and the occurrence of the cleaning failure and the appearance of the cleaning ghost were evaluated while varying the value of the bias applied to the intermediate transfer member cleaning roller 8.

TABLE 2

| | TONER | | | |
|---|---|---|---|---|
| | COMP.EXAMPLE: IRREGULAR NON-MAG. TONER | | EMBODIMENT: IRREGULAR NON-MAG. POLYMERIZED TONER | |
| APPLIED BIAS | CLEANING | CLEANING GHOST | CLEANING | CLEANING GHOST |
| 0 $\mu$A | N | G | N | G |
| 5 $\mu$A | N | G | N | G |
| 10 $\mu$A | N | G | F | G |
| 20 $\mu$A | F | G | G | G |
| 30 $\mu$A | G | G | G | G |
| 40 $\mu$A | G | N | G | F |
| 50 $\mu$A | G | N | G | N |

G: Good,
F: Fair,
N: No good

Referring to Table 2, when the nonmagnetic toner manufactured by the pulverizing method was used as the developer, the cleaning failure occurred when the value of the cleaning bias for charging the residual toner on the intermediate transfer member was in a range of 0–20 $\mu$A, and the appearance of the cleaning ghost was confirmed when the cleaning bias value was no less than 40 $\mu$A, whereas when the cleaning bias value was 30 $\mu$A, the intermediate transfer member cleaning process and the primary transfer process occurred at the same time. On the other hand, in the case of the polymer toner in the irregular form, the cleaning failure occurred when the cleaning bias value was within a range of 0–10 $\mu$A, and the cleaning ghost appeared when the cleaning bias was no less than 40 $\mu$A, indicating that when the cleaning bias value is within a range of 20–30 $\mu$A, the aforementioned residual toner can be successfully cleaned at the same time as the primary transfer process, and therefore, proving that the intermediate transfer member can be successfully cleaned using a relatively low cleaning bias value.

EMBODIMENT 3

(Example 1)

In this example of the third embodiment of the present invention, nonmagnetic single component toner containing substantially spherical microscopic toner particles with a diameter of 7 $\mu$m was employed as the developer. It was produced using the suspension polymerization method, and contained material with a low softening point by 5–30 wt. %. The shape factors SF1 and SF2 for the toner particles were 116 and 109, respectively.

It has been said that as the toner particle shape becomes infinitely closer to being a sphere, transfer efficiency improves. This is thought to be due to the fact that as the toner particle shape becomes infinitely closer to being a sphere, the surface energy of each toner particle becomes smaller, and as a result, the fluidity of the toner increases, weakening thereby the force (mirror force) adhering the toner to the photosensitive drum or the like, and the toner becoming more susceptible to the effects of the transfer electric field.

Figure 13:
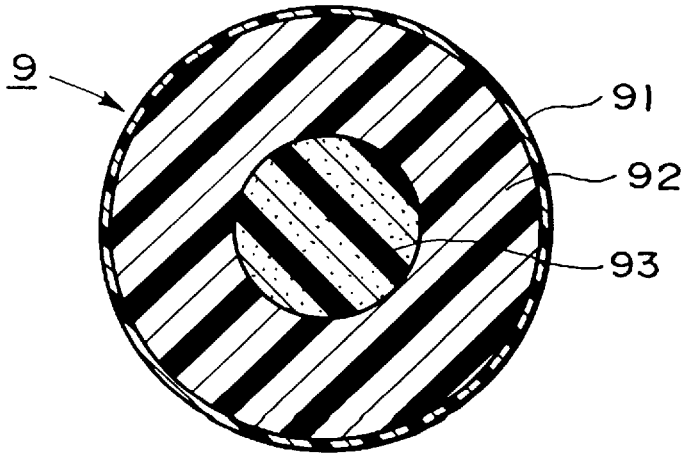
FIG. 13 is a schematic sectional view of the polymer toner in accordance with the present invention.

FIG. 13 schematically depicts the particle structure of the aforementioned polymer toner.

Because of the toner manufacturing method employed in this embodiment, the polymer toner particle 9 of this embodiment became spherical.

In this embodiment, the polymer toner particle comprised a core 93 of ester wax, a resin layer 92 of styrene-butylacrylate, and a surface layer 91 of styrene-polyester. Its specific weight was approximately 1.05. The three layer structure was given for the following reason; the presence of wax core 93 was effective to prevent offset from occurring during the fixing process, and the surface layer 91 of resin material was provided for improving charge efficiency. It should be noted here that in actual usage, oil treated silica was added to stabilize the triboelectric charge.

Figure 9:
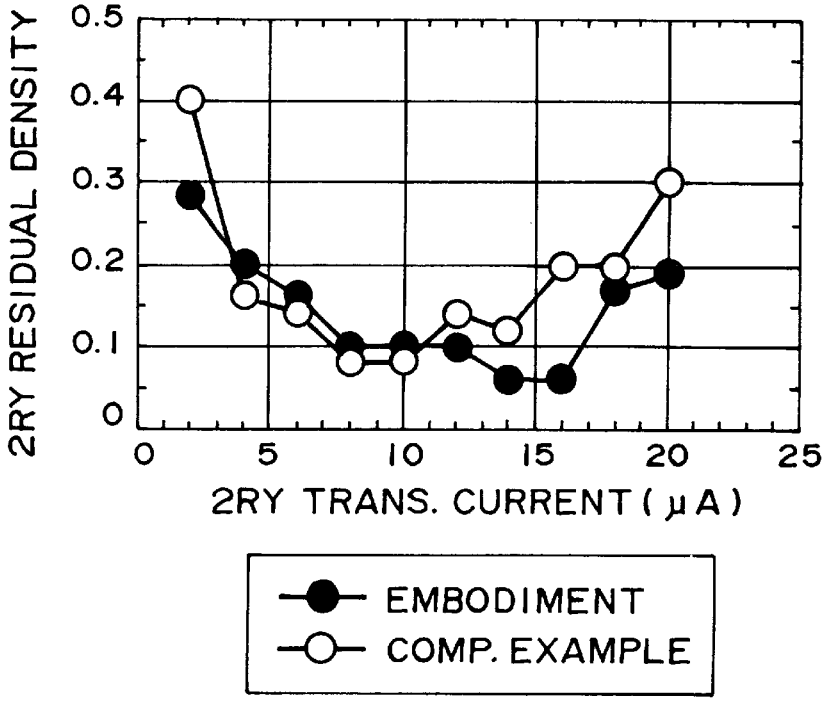
FIG. 9 is a graph showing the relationship between the secondary transfer current, and the density of the toner remaining on the intermediate transfer member after the secondary transfer, in the first example of third embodiment.

FIG. 9 presents a graph showing the secondary transfer bias dependency of the post-secondary transfer residual toner density for the substantially spherical nonmagnetic polymer toner employed in this embodiment. For comparison, the graph also shows the same for the nonmagnetic polymer toner containing the toner particles in the irregular shapes, which were employed in the second embodiment.

In FIG. 9, the minimum value of the post-secondary transfer residual toner density for the nonmagnetic toner containing the substantially spherical toner particles is smaller than that for the nonmagnetic polymer toner containing the toner particles in the irregular forms. In this case, the amount of the toner on the intermediate transfer member 5 before the secondary transfer process was 0.7 mg/cm$^2$.

As for the secondary transfer bias, the optimum secondary transfer bias determinable from FIG. 9 was employed for each toner. More specifically, a bias value of 14 $\mu$A was used for the polymer toner containing the substantial spherical toner particles, which was employed in this embodiment, and a bias value of 8 $\mu$A was used for the polymer toner containing the toner particles in the irregular shapes, which was employed for comparison.

Table 3 presents the results of another experiment in which the polymer toner containing the toner particles in the irregular shapes, and the polymer toner containing the toner particles in the substantially spherical shapes, and the occurrence of the cleaning failure and the appearance of the cleaning ghost, were evaluated while varying the value of the bias applied to the intermediate transfer member cleaning roller 8.

TABLE 3

| | TONER | | | |
|---|---|---|---|---|
| | COMP.EXAMPLE: IRREGULAR NON-MAG. POLYMERIZED TONER | | EMBODIMENT: SPHERICAL NON-MAG. POLYMERIZED TONER | |
| APPLIED BIAS | CLEANING | CLEANING GHOST | CLEANING | CLEANING GHOST |
| 0 $\mu$A | N | G | N | G |
| 5 $\mu$A | N | G | F | G |
| 10 $\mu$A | F | G | G | G |
| 20 $\mu$A | G | G | G | G |
| 30 $\mu$A | G | G | G | G |
| 40 $\mu$A | G | F | G | F |
| 50 $\mu$A | G | N | G | N |

G: Good,
F: Fair,
N: No good

Referring to Table 3, when the polymer toner by the pulverizing method, which contained the toner particles in the irregular shapes, was used as the developer, the cleaning failure occurred when the value of the cleaning bias for charging the residual toner on the intermediate transfer member was in a range of 0–10 $\mu$A, and the appearance of the cleaning ghost was confirmed when the cleaning bias value was no less than 40 $\mu$A, whereas when the cleaning bias value was within a range of 20–30 $\mu$A, the intermediate transfer member cleaning process and the primary transfer process occurred at the same time. On the other hand, in the case of the polymer toner containing the toner particles in the substantially spherical shapes, the cleaning failure occurred when the cleaning bias value was within a range of 0–5 $\mu$A, and the cleaning ghost appeared when the cleaning bias was no less than 40 $\mu$A, indicating that when the cleaning bias value is within a range of 10–30 $\mu$A, the aforementioned residual toner can be successfully cleaned at the same time as the primary transfer process, and therefore, proving that the intermediate transfer member can be successfully cleaned using a relatively low cleaning bias value.

Further studies by the inventors of the present invention confirmed that the effects of the substantial sphericity of the toner particle, which was described in this embodiment, could also be obtained even when the polymer toner containing the toner particles in the substantially spherical shapes, which did not contain the material with a low softening point, was employed.

(Example 2)

In this second example of the third embodiment of the present invention, a nonmagnetic toner was used as the developer. It was manufactured using the pulverizing method, and contained the styrene resin as the binder. It was subjected to mechanical shock, heated air flow, and high temperature liquid, to give the toner particles the substantially spherical shape. After the treatments, the shape factors SF1 and SF2 were 145 and 130, respectively, and the toner particle diameter was 7 $\mu$m.

Figure 10:
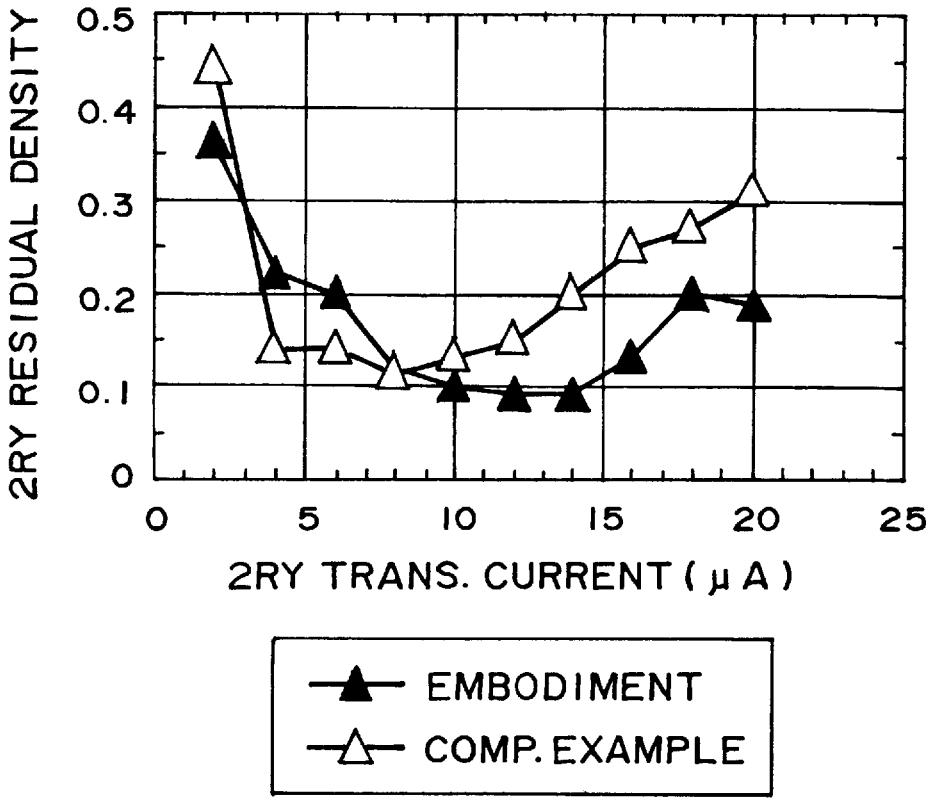
FIG. 10 is a graph showing the relationship between the secondary transfer current, and the density of the toner remaining on the intermediate transfer member after the secondary transfer, in the second example of the third embodiment.

FIG. 10 presents a graph showing the secondary transfer bias dependency of the post-secondary transfer residual toner density for the substantially spherical nonmagnetic polymer toner employed in this embodiment. For comparison, the graph also shows the same for the nonmagnetic polymer toner containing the toner particles in the irregular shapes, which were employed in the first embodiment.

In FIG. 10, the minimum value of the post-secondary transfer residual toner density for the nonmagnetic toner containing the substantially spherical toner particles is smaller than that for the nonmagnetic polymer toner containing the toner particles in the irregular shapes. In this case, the amount of the toner on the intermediate transfer member 5 before the secondary transfer process was 0.7 mg/cm$^2$.

As for the secondary transfer bias, an optimum secondary transfer bias determinable from FIG. 10 was employed for each toner. More specifically, a bias value of 12 $\mu$A was used for the polymer toner containing the substantially spherical toner particles, which was employed in this embodiment, and a bias value of 8 $\mu$A was used for the polymer toner containing the toner particles in the irregular shapes, which was employed for comparison.

Table 4 presents the results of an experiment in which the nonmagnetic toner containing the toner particles in the irregular shapes, and the nonmagnetic toner containing the substantially spherical toner particles, were employed, and the occurrence of the cleaning failure and the appearance of the cleaning ghost, were observed while varying the value of the bias applied to the intermediate transfer member cleaning roller 8.

TABLE 4

| | TONER | | | |
|---|---|---|---|---|
| | COMP.EXAMPLE: IRREGULAR NON-MAG. TONER | | EMBODIMENT: SPHERICAL NON-MAG. TONER | |
| APPLIED BIAS | CLEANING | CLEANING GHOST | CLEANING | CLEANING GHOST |
| 0 $\mu$A | N | G | N | G |
| 5 $\mu$A | N | G | N | G |
| 10 $\mu$A | N | G | N | G |
| 20 $\mu$A | F | G | G | G |
| 30 $\mu$A | G | G | G | G |
| 40 $\mu$A | G | N | G | F |
| 50 $\mu$A | G | N | G | N |

G: Good,
F: Fair,
N: No good

Referring to Table 4, when the nonmagnetic toner containing the toner particles in the irregular shapes was used as the developer, the cleaning failure occurred when the value of the cleaning bias for charging the residual toner on the intermediate transfer member was in a range of 0–20 μA, and the appearance of the cleaning ghost was confirmed when the cleaning bias value was no less than 40 μA, whereas when the cleaning bias value was 30 μA, the intermediate transfer member cleaning process and the primary transfer process occurred at the same time. On the other hand, in the case of the non magnetic toner containing the substantially spherical toner particles, the cleaning failure occurred when the cleaning bias value was within a range of 0–10 μA, and the cleaning ghost appeared when the cleaning bias was no less than 40 μA, indicating that when the cleaning bias value is within a range of 20–30 μA, the aforementioned residual toner can be successfully cleaned at the same time as the primary transfer process, and therefore, proving that the intermediate transfer member can be successfully cleaned using a relatively low cleaning bias value.

EMBODIMENT 4

In this fourth embodiment of the present invention, a magnetic toner containing substantially spherical toner particles with a diameter of 7 μm was used as the developer. This toner was manufactured by mixing 100 parts of magnetic material such as magnetite with polymer material such as styrene-butylacrylate-butylmaleate halfester copolymer, and pulverizing the compound. Further, the pulverized compound was subjected to mechanical shock, heated air flow, high temperature liquid, to give the toner particles substantially spherical shapes. The shape factors SF1 and SF2 of the resultant toner particle were 145 and 130, respectively. Further, oil treated silica was added as an additive. For comparison, a magnetic toner containing toner particles in the irregular shapes was employed. This comparative toner was manufacture by mixing 100 parts of magnetic material such as magnetite with polymer material such as styrene-butylacrylate-butylmaleate halfester copolymer, and pulverizing the compound. The shape factors SF1 and SF2 of the resultant toner particle were 156 and 246, respectively, and the particle diameter was 7 μm. Further, the oil treated silica was added.

Figure 11:
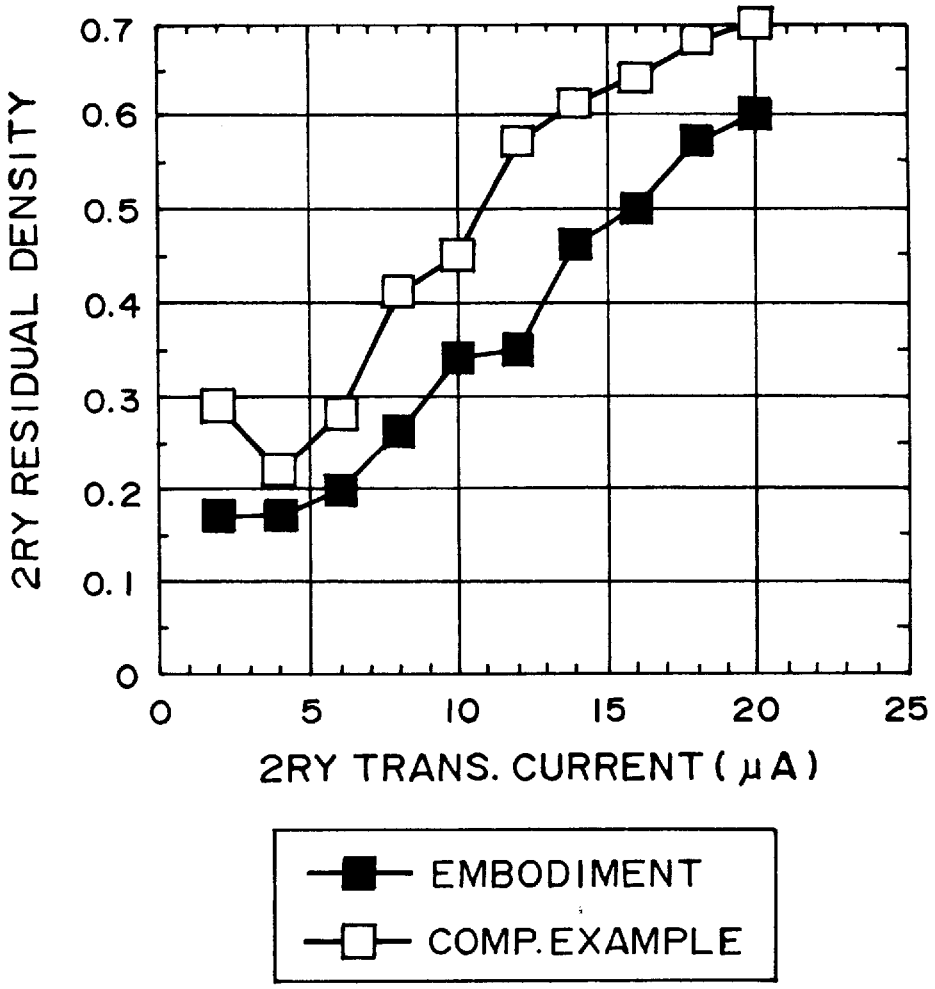
FIG. 11 is a graph showing the relationship between the secondary transfer current, and the density of the toner remaining on the intermediate transfer member after the secondary transfer, in the fourth embodiment.

FIG. 11 presents a graph showing the secondary transfer bias dependency of the post-secondary transfer residual toner density for the substantially spherical magnetic toner employed in this embodiment. For comparison, the graph also shows the same for the magnetic toner containing the toner particles in the irregular shapes.

In FIG. 11, the minimum value of the post-secondary transfer residual toner density for the magnetic toner containing the substantially spherical toner particles is smaller than that for the magnetic toner containing the toner particles in the irregular shapes. In this case, the amount of the toner on the intermediate transfer member 5 before the secondary transfer process was 0.7 mg/cm$^2$.

As for the secondary transfer bias, an optimum secondary transfer bias determinable from FIG. 11 was employed for each toner. More specifically, a bias value of 4 μA was used for both the magnetic toner containing the substantially spherical toner particles, which was employed in this embodiment, and the polymer toner containing the toner particles in the irregular shapes, which was employed for comparison.

Table 5 presents the results of an experiment in which the magnetic toner containing the toner particles in the irregular shapes, and the magnetic toner containing the substantially spherical toner particles, were employed, and the occurrence of the cleaning failure and the appearance of the cleaning ghost, were evaluated while varying the value of the bias applied to the intermediate transfer member cleaning roller 8.

TABLE 5

| | TONER | | | |
|---|---|---|---|---|
| | COMP.EXAMPLE: IRREGULAR MAG. TONER | | EMBODIMENT: SPHERICAL MAG. TONER | |
| APPLIED BIAS | CLEANING | CLEANING GHOST | CLEANING | CLEANING GHOST |
| 0 μA | N | G | N | G |
| 5 μA | N | G | N | G |
| 10 μA | N | G | N | G |
| 20 μA | N | G | N | G |
| 30 μA | N | G | N | G |
| 40 μA | F | G | G | G |
| 50 μA | F | G | G | N |

G: Good,
F: Fair,
N: No good

Referring to Table 5, when the magnetic toner containing the toner particles in the irregular shapes was used as the developer, the cleaning failure occurred no matter which value in the table was selected for the cleaning bias for charging the residual toner on the intermediate transfer member; therefore, the intermediate transfer member cleaning process concurrent with the primary transfer process, which characterizes the present invention, could not be carried out. On the other hand, in the case of the magnetic toner containing the substantially spherical toner particles, the cleaning failure occurred when the cleaning bias value was within a range of 0–30 μA, and the cleaning ghost appeared when the cleaning bias was no less than 50 μA, indicating that when the cleaning bias value is 40 μA, the aforementioned residual toner can be successfully cleaned at the same time as the primary transfer process.

In other words, the fourth embodiment proves that the intermediate transfer member cleaning method in accordance with the present invention is compatible even with the magnetic toner as long as the toner particle is given the substantially spherical shape.

EMBODIMENT 5

Next, a structure for enhancing the effects of the present invention will be described. In this structure, a mold releasing layer is provided on the surface of a photosensitive drum.

Figure 14:
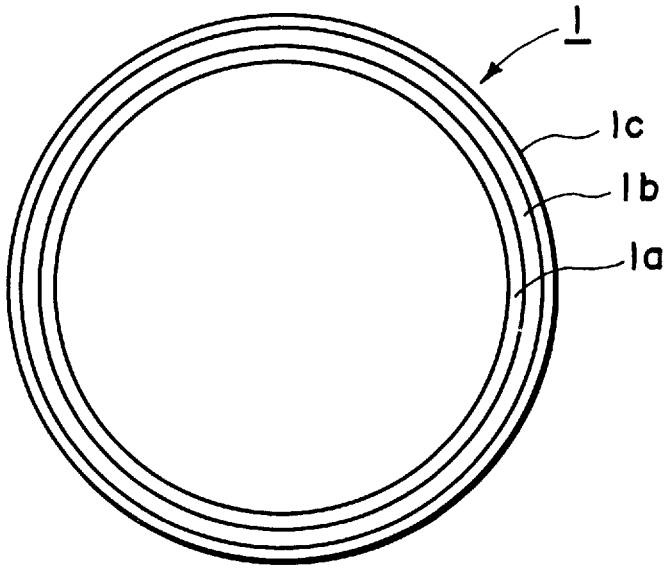
FIG. 14 is a schematic section of the structure of a photosensitive drum in accordance with the present invention.

Referring to FIG. 14, the photosensitive drum 1 employed in this embodiment will be described. In this embodiment, two types of photosensitive drum were prepared.

First, a photosensitive drum for comparison (hereinafter, a first photosensitive drum) was prepared, which comprised a metallic core 1*a* of aluminum with an external diameter of approximately 60 mm, a carrier generation layer 1*b*, as the photosensitive layer, composed of 0.2 μm thick phthalocyanine compound laminated on the metallic core, and a carrier transfer layer 1*c* laminated on the carrier generation layer 1*b*. The carrier generation layer was composed of polycarbonate binder, and hydrazone compound dispersed within the binder.

As for the photosensitive drum in accordance with the present invention (hereinafter, a second photosensitive drum), it was substantially the same as the first photosensitive drum except that Teflon particles as fluorine containing particles were dispersed in the carrier transfer layer by 10%.

The dispersion of the Teflon was to improve the mold releasing properties of the photosensitive drum surface. However, in order to prevent the Teflon from impeding the primary function of the carrier transfer layer, the amount of Teflon to be added is preferred to be no more than 20%.

As for the contact angle of the photosensitive drum surface relative to water, and the slipperiness of the photosensitive drum surface, the first photosensitive drum had a contact angle of 85°, but did not show the slipperiness at all, that is, the slipperiness could not be measured, whereas the second photosensitive drum had a contact angle of 95°, and a slipperiness of 0.8.

The slipperiness was measured using a slipperiness tester of HEIDON, and the slipperiness of a test subject was given as a ratio relative to the slipperiness (1.0) of polyethylene terephthalate (PET); the smaller the value, the more slippery.

The results of various experiments conducted using the image forming apparatus illustrated in FIG. 1 will be presented below. As for the contact timing between the cleaning roller 8 and the surface of the intermediate transfer member 5, when in a monochromatic continuous printing mode, the cleaning roller 8 was placed in contact with the intermediate transfer member 5 at the same time as the initiation of the primary transfer process. This was to prevent the image from being disturbed by the effects such as vibrations from the contact. When in a mode for transferring four images of different colors all at once, the contact was initiated at the same time as the completion of the primary transfer process of the fourth color image.

Figure 15:
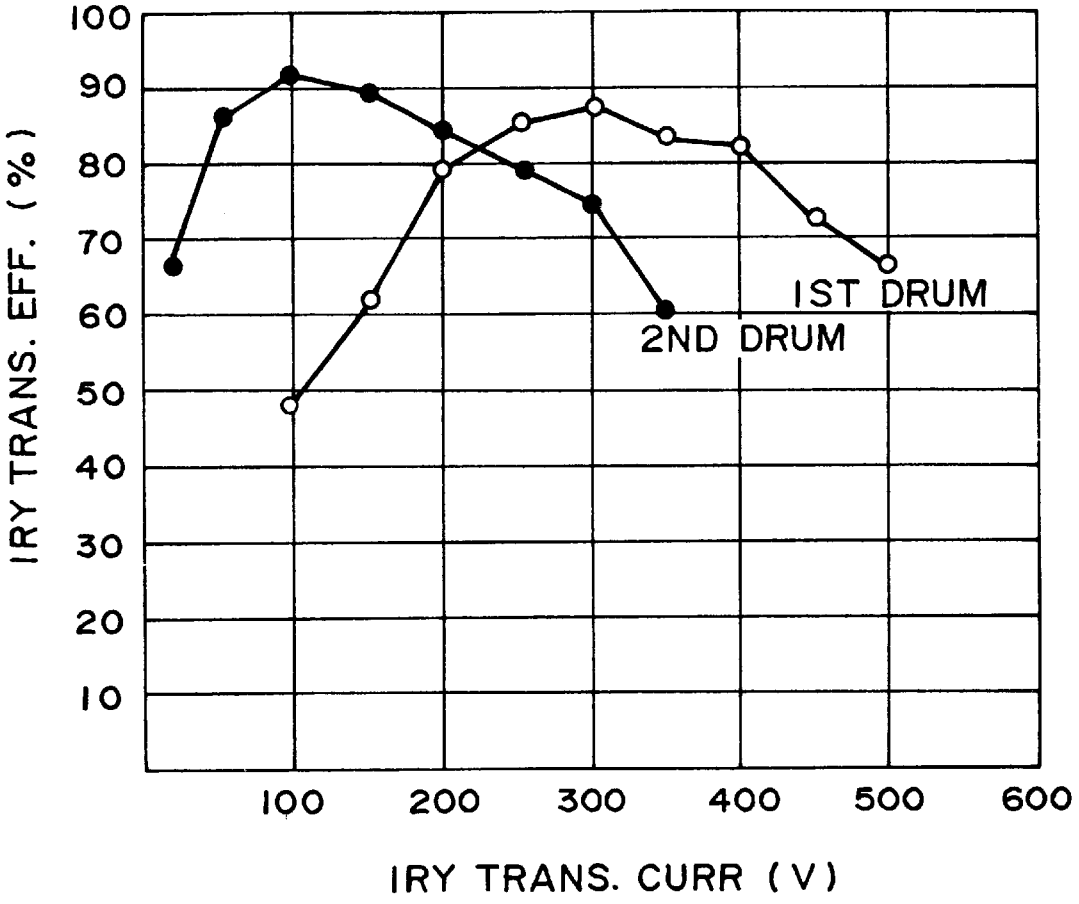
FIG. 15 is a graph showing the primary transfer bias dependency of the primary transfer efficiency.

First, the primary transfer bias dependency of the primary transfer efficiency, which was measured when the toner on the surface of the photosensitive drum 1 was transferred onto the surface of the intermediate transfer member 5 through the primary transfer process without cleaning the intermediate transfer member, is shown in FIG. 15.

The primary transfer efficiency was calculated from the following formula, wherein D1 stands for the toner density on the surface of the photosensitive drum 1 measured after the primary transfer process, and D2 stands for the toner density on the surface of the intermediate transfer member 5 measured after the primary transfer process:

$$\text{primary transfer efficiency}=D2/(D1+D2)\times 100.$$

As for the method employed to measure the aforementioned toner density, the toners on the surfaces of the photosensitive drum 1 and the intermediate transfer member 5 were collected by taping, and the densities of the collected toners were measured using a Macbeth densitometer. The values of D1 and D2 were obtained by subtracting the density of the collection tape itself, which was 0.1 in this embodiment, from the actual measured densities.

Referring to FIG. 15, the second photosensitive drum provided a higher transfer efficiency using a relatively low primary transfer bias than the first photosensitive drum.

The reason for the above results is thought to be that the fluorine containing particles added to the carrier transfer layer of the second photosensitive drum improved the mold releasing properties.

When a high primary transfer efficiency can be obtained using a low primary transfer bias as shown in FIG. 15, the toner with the normal polarity is not charged to the reverse polarity during the primary transfer process, which leads to the improvement of the toner transfer efficiency for the following process, that is, the secondary transfer process. As a result, the density of the image to be outputted can be sufficiently increased.

Figure 16:
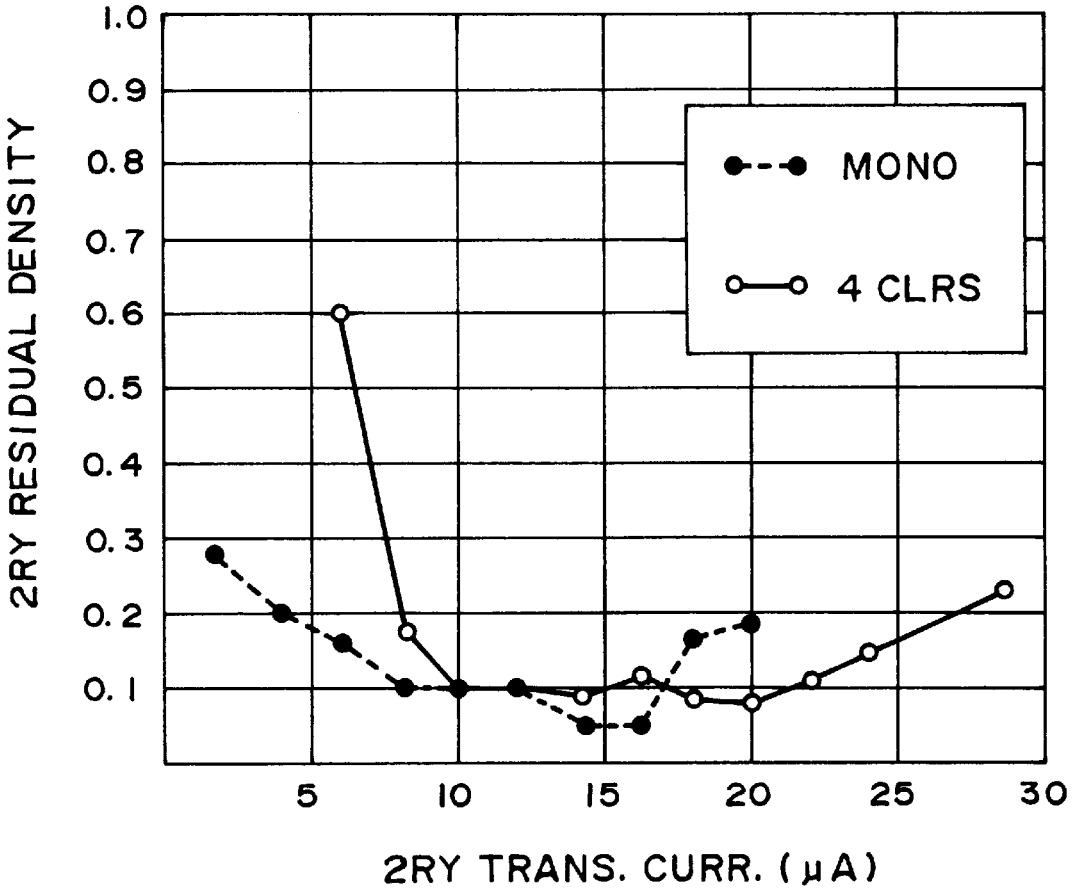
FIG. 16 is a graph showing the secondary transfer bias dependency of the post-secondary transfer residual toner density.
Figure 19:
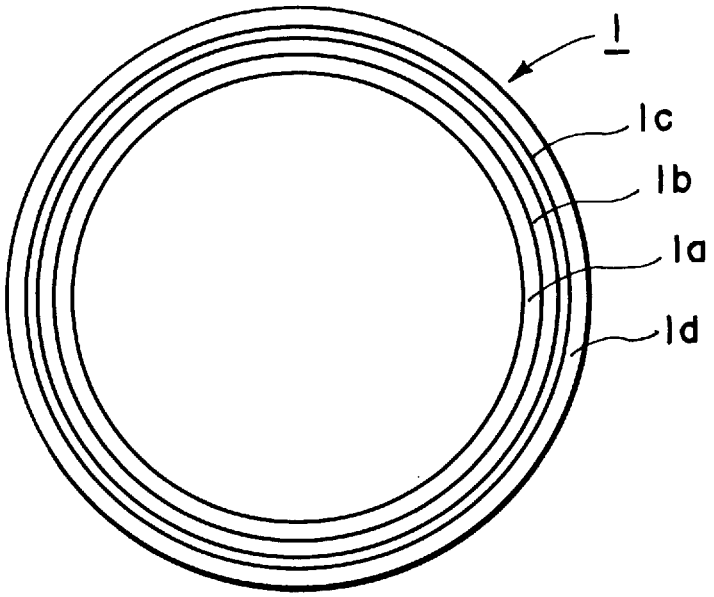
FIG. 19 is a schematic sectional view of the photosensitive drum in another embodiment of the present invention.

Next, FIG. 16 shows the secondary transfer bias dependency of the density of the toner remaining on the surface of the intermediate transfer member 5 after the toner on the surface of the intermediate transfer member 5 was transferred onto the recording medium P through the secondary transfer process. As for the measurement of the toner density, the post-secondary transfer residual toner on the surface of the intermediate transfer member 5 was collected by taping, and the density of the collected residual toner was measured using a Macbeth densitometer; the smaller the measured density, the smaller the amount of the post-secondary transfer residual toner on the surface of the intermediate transfer member 5. The amount M/S of the toner on the surface of the intermediate transfer member 5 before the secondary transfer process was set at 0.5 mg/cm$^2$ for the monochromatic mode, and 1.4 mg/cm$^2$ for the four color mode.

According to FIG. 16, in both the monochromatic mode and the four color mode, the residual toner density became minimum when the secondary transfer bias was in an approximate range of 10–15 $\mu$A. In other words, the secondary transfer efficiency became maximum.

As described previously, in order to preferably clean the intermediate transfer member of this embodiment, the amount of the residual toner on the surface of the intermediate transfer member 5 is preferred to be as small as possible.

When the amount of the residual toner is large, it becomes necessary to apply a strong electric field in order to attract the residual toner back to the photosensitive drum 1 by charging the residual toner using the cleaning roller 8.

When the cleaning was carried out using a strong electric field, a portion of the toner particles, which have been already charged to the reverse (positive) polarity during the secondary transfer process, are charged to a higher level, creating a condition in which toner particles having been charged to an abnormally high level are present, that is, the condition in which a phenomenon called cleaning ghost is liable to occur. In view of the discovery described above, in the experiments conducted after the experiment described above, the secondary transfer bias was set at 12 $\mu$A.

Next, the results of an experiment related to the cleaning of the intermediate transfer member which characterizes the present invention will be presented. This experiment was conducted to confirm the dependency of the intermediate transfer member cleaning performance on the cleaning bias applied to the cleaning roller 8, under the following conditions which were set up based on the results of the preceding experiment; the primary transfer bias was set at 300 V when the first photosensitive drum was employed, and 100 V when the second photosensitive drum was employed; and the secondary transfer bias was set at 12 $\mu$A.

FIG. 17 presents the results for the first photosensitive drum, and FIG. 18 presents the results for the second photosensitive drum. In the figures, "cleaning failure" means an undesirable condition in which a certain portion of the post-secondary transfer residual toner on the surface of the intermediate transfer member 5, which could not be attracted back to the surface of the photosensitive drum 1 in spite of the function of the cleaning roller 8, appeared, as a positive ghost, in a solid white region of the following print, that is, an undesirable condition in which the image composed of the post-secondary transfer residual toner from the first print appeared in the solid white region of the second print.

It is evident from FIGS. 17 and 18 that whether the first photosensitive drum was employed or the second photosensitive drum was employed, the proper range for the value of the bias applied to the cleaning roller 8, that is, the range in which both the cleaning failure, and the appearance of the cleaning ghost could be prevented, slightly shifted toward the higher side when in the four color mode, compared to when in the monochromatic mode.

This occurred because the electric field to which the toner on the surface of the intermediate transfer member 5 is subjected during the secondary transfer process varied; in the monochromatic mode, the major portion of the toner was charged to the reverse polarity, whereas in the four color mode, the amount of the toner on the surface of the intermediate transfer member 5 was larger, and therefore, the amount of the toner charged to the reverse polarity became slightly smaller.

Further, the aforementioned proper range became wider, in particular on the upper limit side, when the second photosensitive drum was employed than when the first photosensitive drum was employed.

This is because the appearance of the cleaning ghost is related to the balance among the primary transfer bias which acts, at the primary transfer point, on the toner to be transferred from the surface of the photosensitive drum 1 onto the surface of the intermediate transfer member 5 through the primary transfer process, the ease with which the toner is released from the surface of the photosensitive drum 1, in other words, the mold releasing properties of the surface of the photosensitive drum 1, and the electrostatic attraction of the toner being pulled back from the surface of the intermediate transfer member 5 to the surface of the photosensitive drum 1.

In other words, in the case of the second photosensitive drum, the mold releasing properties were improved by the addition of the fluorine particles to the carrier transfer layer 1*c;* therefore, the primary transfer bias could be lowered. The lowered primary bias prevented the toner polarity from being reversed through the primary transfer process. As a result, the condition in which the toner particles with the positive polarity of a high level are present among the toner particles remaining on the intermediate transfer member 5 after the secondary transfer was not created. Consequently, the proper range of the bias to be applied to the cleaning roller 8 became wider.

Availability of a wider range for the cleaning bias value such as the one described in the foregoing greatly contributes to the preferable cleaning of the intermediate transfer member 5, in consideration of the variation of the resistance value of the intermediate transfer member 5 or the cleaning roller 8, which occurs due to manufacturing error, the fluctuation of the resistance value of the intermediate transfer member 5 or the cleaning roller 8, which is resultant from environmental changes, and the fluctuation of the amount of the toner on the surface of the intermediate transfer member 5. Thus, the use of a photosensitive drum having the surface with superior mold releasing properties becomes effective.

When a continuous printing test was conducted, in which the cleaning roller 8 described above in detail, and the second photosensitive drum 1 with the surface layer having the mold releasing properties were employed, and 100,000 prints were continuously produced, the intermediate transfer member could be preferably cleaned, and the cleaning roller 8, the rotation of which was slaved to the rotation of the intermediate transfer member 5, did not show any sign of wear.

When the structure described above is employed, the intermediate transfer member can be cleaned at the same time as the primary transfer process is carried out; therefore, when a number of prints are continuously produced using a color laser printer, a color copying machine, or the like, the step for cleaning the surface of the intermediate transfer member 5 does not need to be inserted after each print is outputted. As a result, the throughput can be improved by a large scale.

In this embodiment, the polymer toner produced using the suspension polymerization method was used as the developer, but even when the toner produced using an ordinary pulverization method is used, the same effects can be obtained as long as the intermediate transfer member cleaning bias is optimized.

EMBODIMENT 6

Next, another embodiment of the present invention, which is related to the improvement of the photosensitive drum surface, will be described. In this embodiment, the components equivalent to those described in the preceding embodiments are given the same referential symbols, and their descriptions are omitted. This embodiment is characterized in that the photosensitive drum 1 of this embodiment, which was structurally similar to that described in the fifth embodiment, was provided with a surface layer 1*d* with mold releasing properties, which was formed on the peripheral surface of the carrier transfer layer 1*c*.

The photosensitive drum 1 of this embodiment comprised a metallic core 1*a* of aluminum with an external diameter of approximately 60 mm, a 0.2 $\mu$m thick carrier generation layer 1*b* formed on the metallic core 1*a,* a 15 $\mu$m thick carrier transfer layer 1*c* formed on the carrier generation layer 1*b,* and a 3 $\mu$m thick mold releasing layer 1*d* formed on the carrier transfer layer 1*c* by dipping.

This surface protection layer 1*d* was composed of a binder, which was ultraviolet hardenable acrylic, and fluorine particles (Teflon: commercial name) dispersed in the binder by 35%. The diameters of the fluorine particles were approximately 0.3 $\mu$m.

When the photosensitive drum 1 is provided with two separate layers, that is, the carrier transfer layer and the surface layer for improving the mold releasing properties of the photosensitive drum 1, in order to separate two functions, in other words, when the carrier generation layer described in the preceding embodiment is separated into a pure carrier generation layer and a surface layer for improving the mold releasing properties of the photosensitive drum 1 (mold releasing surface layer), a larger amount of the fluorine particles can be added (to the mold releasing surface layer) than when the carrier generation has to perform two functions.

More specifically, the measured contact angle relative to water, and the measured slipperiness, of the surface of the photosensitive drum employed in this embodiment was 100° and 0.4, respectively.

As for the amount of the fluorine particles to be added to the surface layer in order to improve the mold releasing properties, when they are added by a too large amount, the binding force of the binder is weakened in relative terms; in other words, the strength of the surface layer is reduced, making the surface layer brittle. Therefore, the amount of the fluorine particles is preferred to be no more than 45%.

FIG. 20 shows the results of an experiment, which was conducted using the photosensitive drum 1 described above, to prove that the efficiency with which the surface of the intermediate transfer member is cleaned is dependent on the cleaning bias applied to the cleaning roller 8.

The method used for the experiment, and the conditions under which the experiment was conducted, were the same as those described in the fifth embodiment; therefore, their descriptions will be omitted.

As is evident from FIG. 20, the proper range for the intermediate transfer member cleaning bias for the photosensitive drum 1 of this embodiment became wider, in particular, on the top end side, than that for the second photosensitive drum described in the fifth embodiment.

This can be thought to be because the improvement of the mold releasing properties of the surface of the photosensitive drum in this embodiment was better than that of the second photosensitive drum described in the fifth embodiment, which is evident from the measured contact angle and slipperiness.

When a continuous printing test was conducted using the photosensitive drum of this embodiment, in which 100,000 images were continuously formed as described in the fifth embodiment, the intermediate transfer member 5 was reliably and preferably cleaned.

EMBODIMENT 7

Next, another embodiment of the present invention will be described. Also in this embodiment, a surface layer Id for improving the mold releasing properties was formed as the outermost layer of the photosensitive drum 1 as in the sixth embodiment. However, in this embodiment, it was formed using a spraying method, which characterizes this embodiment. The structure of the apparatus was substantially the same as that in the fifth embodiment, except that the photosensitive drum 1 was different.

More specifically, the photosensitive drum 1 of this embodiment comprised a metallic core 1*a* of aluminum with an external diameter of approximately 60 mm, a 0.2 μm thick carrier generation layer 1*b* formed on the metallic core 1*a*, a 15 μm thick carrier transfer layer 1*c* formed on the carrier generation layer 1*b*, and a 3 μm thick mold releasing layer 1*d* formed on the carrier transfer layer 1*c* by spraying. This surface protection layer 1*d* was composed of a binder, which was polycarbonate, and fluorine particles (Teflon: commercial name) dispersed in the binder by 35%. The diameters of the fluorine particles were approximately 0.3 μm. The measured contact angle relative to water, and the measured slipperiness, of the surface of the photosensitive drum employed in this embodiment was 104° and 0.2, respectively.

The reason why the values of the contact angle and the slipperiness for the photosensitive drum of this embodiment were better than those for the photosensitive drum described in the sixth embodiment can be thought to be that polycarbonate used as the binder in this embodiment was superior in slipperiness to acrylic.

FIG. 21 shows the results of an experiment, which was conducted, using the photosensitive drum 1 described above, to prove that the efficiency with which the surface of the intermediate transfer member 5 is cleaned is dependent on the cleaning bias applied to the cleaning roller 8. The method used for the experiment, and the conditions under which the experiment was conducted, were the same as those described in the fifth embodiment; therefore, their descriptions will be omitted.

As is evident from FIG. 21, the proper range for the intermediate transfer member cleaning bias became wider, in particular, on the top end side, when the photosensitive drum 1 of this embodiment was employed, as when the photosensitive drum described in the sixth embodiment was employed, than when the second photosensitive drum described in the fifth embodiment was employed.

This can be thought to be because the improvement of the mold releasing properties of the surface of the photosensitive drum in this embodiment was better than that of the second photosensitive drum described in the fifth embodiment, which is evident from the aforementioned measured contact angle and slipperiness.

When a continuous printing test was conducted using the photosensitive drum of this embodiment, in which 100,000 images were continuously formed as described in the fifth embodiment, the intermediate transfer member 5 was reliably and preferably cleaned.

Next, the toner used with the photosensitive drum in the preceding embodiment 5, 6 or 7 will be described.

As described in the preceding embodiments, when a photosensitive drum with mold releasing properties is used with a toner containing substantially spherical toner particles, the value of the primary transfer bias can be lowered. The primary transfer bias with a lower value is less likely to neutralize the triboelectric charge of the toner on the intermediate transfer member 5, improving the secondary transfer efficiency. As a result, the intermediate transfer member can be successfully cleaned, in practical terms, at the same time as the primary transfer process is carried out; successful reverse transfer in accordance with the present invention becomes possible.

As for the developing method, a known noncontact developing method (jumping developing method) using a single component developer was employed.

As for the toner usable with the present invention, the toner produced using a conventional pulverization method may be employed after giving it a more spherical particle shape. The shape factors SF1 and SF2 of the toners employed in the aforementioned embodiments were 110–180, and 110–140, preferably, 120–160 and 115–140, respectively. The volumetric average diameter of the toner particle was in a range of 6–7 μm.

The toner employed in the preceding embodiments was a magnetic toner containing substantially spherical toner particles, and was manufactured using the following method; 100 parts of magnetic material such as magnetite was mixed into a binder, which was styrene-butylacrylate-butylmaleate halfester; the thus obtained compound was pulverized; the pulverized compound was subjected to mechanical shock, heated air flow, and high temperature liquid, to give the compound particles spherical shapes with the shape factors SF1 and SF2 of 145 and 130, respectively. The particle diameter was 7 μm. As for the additive, oil treated silica was used.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member for bearing an electrostatic image, said image bearing member having a surface layer comprising fluorine;

developing means for developing the electrostatic image with toner into a toner image;

an intermediate transfer member;

primary transfer means for effecting a primary image transfer of the toner image from said image bearing member onto said intermediate transfer member at a first transfer position;

secondary transfer means for effecting a secondary image transfer of the toner image from said intermediate transfer member onto a transfer material at a second transfer position;

charging means for charging the toner remaining on said intermediate transfer member after the secondary image transfer to a polarity opposite from a polarity of charged toner in said developing means;

wherein at said first transfer position, an electric field is formed such that the toner charged by said charging means is transferred from said intermediate transfer member onto said image bearing member simultaneously with the primary transfer of another toner image.

2. An apparatus according to claim 1, wherein said image bearing member is charged to a polarity which is the same as the polarity of the charged toner to form the electrostatic image.

3. An apparatus according to claim 1, wherein the electrostatic image is developed through reverse-development.

4. An apparatus according to claim 1, wherein the toner contains magnetic toner.

5. An apparatus according to claim 1, wherein the toner contains non-magnetic toner.

6. An apparatus according to claim 1, wherein the toner is polymerized toner.

7. An apparatus according to claim 1, wherein said charging means includes a roller contactable to said intermediate transfer member.

8. An apparatus according to claim 1, wherein said image bearing member is capable of bearing a plurality of colors of toner images, and wherein the toner images are sequentially and superposedly transferred onto the intermediate transfer member by said primary transfer means at the first transfer position, and then the toner images are transferred from the intermediate transfer member onto the transfer material all together at the secondary transfer position.

* * * * *

UNITED STATES PATENT AND TRADEMARK OFFICE

CERTIFICATE OF CORRECTION

PATENT NO. : 5,809,373

DATED : September 15, 1998

INVENTORS : YASUO YODA, ET AL.

It is certified that error appears in the above-identified patent and that said Letters Patent is hereby corrected as shown below:

COLUMN 3,
Line 52, "conditions." should read --condition.--.

COLUMN 6,
Line 60, "means" should read --mean--.

COLUMN 16,
Line 5, "result-," should read --result,--.

COLUMN 21,
Line 33, "manufacture" should read --manufactured--.

Signed and Sealed this

Twentieth Day of April, 1999

*Attest:*

Q. TODD DICKINSON

*Attesting Officer*

*Acting Commissioner of Patents and Trademarks*